US008760058B2

(12) United States Patent
Song et al.

(10) Patent No.: US 8,760,058 B2
(45) Date of Patent: Jun. 24, 2014

(54) HEAT SINK AND LED ILLUMINATING APPARATUS COMPRISING THE SAME

(75) Inventors: Tae Hoon Song, Seongnam-si (KR); Min Uk Yoo, Seongnam-si (KR); Dae Won Kim, Seongnam-si (KR); Jung Hwa Kim, Seongnam-si (KR); Sun Hwa Lee, Seongnam-si (KR)

(73) Assignee: Posco LED Company Ltd., Seongnam-si (KR)

( * ) Notice: Subject to any disclaimer, the term of this patent is extended or adjusted under 35 U.S.C. 154(b) by 0 days.

(21) Appl. No.: 13/526,091

(22) Filed: Jun. 18, 2012

(65) Prior Publication Data

US 2013/0200796 A1 Aug. 8, 2013

(30) Foreign Application Priority Data

Feb. 2, 2012 (KR) ..... 10-2012-0010912
Apr. 27, 2012 (KR) ..... 10-2012-0044592
Apr. 27, 2012 (KR) ..... 10-2012-0044594

(51) Int. Cl.
*H01J 13/32* (2006.01)

(52) U.S. Cl.
USPC ..... 315/113; 315/277; 315/192; 315/307; 315/158

(58) Field of Classification Search
CPC ..... F21K 9/00; F21V 19/045; H01L 33/00
USPC ..... 315/113, 185 R
See application file for complete search history.

(56) References Cited

U.S. PATENT DOCUMENTS 4,329,625 A * 5/1982 Nishizawa et al. ..... 315/158
6,641,294 B2 * 11/2003 Lefebvre ..... 362/544
7,093,956 B2 8/2006 Miller et al.
8,076,680 B2 * 12/2011 Lee et al. ..... 257/88
8,337,049 B2 * 12/2012 Shida et al. ..... 362/294

(Continued)

FOREIGN PATENT DOCUMENTS

JP 61-156954 10/1986
JP 2006-080095 3/2006

(Continued)

OTHER PUBLICATIONS

S W Amos "Newnes Dictionary of Electronics" Fouth edition 1999, Newns, pp. 226, 227and 288,289.*

(Continued)

*Primary Examiner* — Douglas W Owens
*Assistant Examiner* — Srinivas Sathiraju
(74) *Attorney, Agent, or Firm* — H.C. Park & Associates, PLC

(57) ABSTRACT

A light emitting diode (LED) illuminating apparatus including a heat sink, a light emitting module, a power connection portion, a translucent cover and a wiring path. The heat sink has a plurality of heat dissipation fins. The light emitting module is positioned on an upper portion of the heat sink. The power connection portion is positioned below a lower portion of the heat sink. The translucent cover is mounted to cover an upper portion of the light emitting module. The wiring path is formed in the heat sink so as to accommodate a wire for electrically connecting the power connection portion and the light emitting module. In the LED illuminating apparatus, the light emitting module emits light by directly receiving AC power supplied through the wire accommodated in the wiring path.

24 Claims, 13 Drawing Sheets

(56) References Cited

U.S. PATENT DOCUMENTS

| | | | | |
|---|---|---|---|---|
| 8,400,073 | B2 * | 3/2013 | Byun et al. | 315/291 |
| 8,410,717 | B2 * | 4/2013 | Shteynberg et al. | 315/291 |
| 8,476,836 | B2 * | 7/2013 | van De Ven et al. | 315/193 |
| 8,492,981 | B2 * | 7/2013 | Shin et al. | 315/185 R |
| 8,517,593 | B2 * | 8/2013 | Urano | 362/649 |
| 2009/0267085 | A1 | 10/2009 | Lee et al. | |
| 2011/0228550 | A1 * | 9/2011 | Robinson | 362/555 |
| 2011/0291542 | A1 * | 12/2011 | Lu et al. | 313/46 |

FOREIGN PATENT DOCUMENTS

| | | |
|---|---|---|
| JP | 2006-319333 | 11/2006 |
| JP | 2007-258690 | 10/2007 |
| JP | 2010-033863 | 2/2010 |
| JP | 2010-033959 | 2/2010 |
| JP | 2010-245037 | 10/2010 |
| JP | 2011-014306 | 1/2011 |
| JP | 2011-228254 | 11/2011 |
| KR | 10-2006-0098229 | 9/2006 |
| KR | 10-0759055 | 9/2007 |
| KR | 20-2008-0002869 | 7/2008 |
| KR | 10-2010-0004035 | 1/2010 |
| KR | 10-0943074 | 2/2010 |
| KR | 10-2011-0002883 | 1/2011 |

OTHER PUBLICATIONS

International Search Report dated Dec. 21, 2012 issued for PCT/KR2012/004780.

Japanese Preliminary Rejection issued on Oct. 16, 2012 in Japanese Patent Application No. 2012-145446.

* cited by examiner

HEAT SINK AND LED ILLUMINATING APPARATUS COMPRISING THE SAME

CROSS REFERENCE TO RELATED APPLICATIONS

This application claims priority from and the benefit of Korean Patent Application No. 10-2012-0010912, filed on Feb. 2, 2012; No. 10-2012-0044592, filed on Apr. 27, 2012; and No. 10-2012-0044594, filed on Apr. 27, 2012, all of which are hereby incorporated by reference for all purposes as if fully set forth herein.

BACKGROUND OF THE INVENTION

1. Field of the Invention

The present invention relates to a light emitting diode (LED) illuminating apparatus, and more particularly, to a lamp-type LED illuminating apparatus.

2. Description of the Related Art

Fluorescent lamps and incandescent electric lamps have been used as light sources for illumination so far. The efficiency and economic feasibility of the incandescent electric lamps are lowered due to high power consumption, and hence demands for the incandescent electric lamps tend to be considerably decreased. It is expected that such a decreasing tendency will be continued in the future. On the other hand, the power consumption of the fluorescent lamps is about ⅓ of that of the incandescent electric lamps, and hence the fluorescent lamps are highly efficient and economical. However, the fluorescent lamps have a problem in that blacking of the fluorescent lamps is caused due to high voltage applied to the fluorescent lamps, and therefore, the lifespan of the fluorescent lamps is shortened. Since the fluorescent lamps use vacuum glass tubes into which mercury as a heavy metal is injected together with argon gas, there is a disadvantage in that the fluorescent lamps are non-environmentally friendly.

Recently, demands for a light emitting diode (LED) illuminating apparatus including an LED as a light source have been rapidly increased. The LED illuminating apparatus has long lifespan and lower power driving. Further, the LED illuminating apparatus does not use an environmentally harmful substance such as mercury, and thus is environmentally friendly.

There have been developed various kinds of LED illuminating apparatuses having various structures, and a lamp-type LED illuminating apparatus including a similar form of the incandescent electric lamp or bulb has been developed as one of the LED illuminating apparatuses.

In a conventional lamp-type LED illuminating apparatus, a socket base as a power connection portion is mounted to the bottom of a body portion including a heat sink, a light emitting module having a printed circuit board (PCB) and LEDs mounted on the PCB is mounted to an upper portion of the body portion, and a translucent cover is mounted to cover the top of the light emitting module. The body portion includes the heat sink and an insulative housing, and the heat sink includes a plurality of dissipation fins. The heat sink has a core structure at the inner center of the body portion, and components such as a switching mode power supply (SMPS) and a wire are positioned in the core structure. Here, the SMPS converts AC current into DC current and supplies the converted DC current to the LED in the light emitting module.

In the conventional LED illuminating apparatus, the heat dissipation performance of the heat sink is lowered due to the body portion, the core structure required in the center of the heat sink and several components in the core structure. This results from that the area of the heat dissipation fins exposed to the atmosphere is decreased by the core structure and the insulative housing for covering several components in the core structure. The conventional LED illuminating apparatus has a disadvantage in that it is difficult to decrease the weight of the conventional LED illuminating apparatus due to the core structure and the components such as the SMPS positioned in the core structure, furthermore, the insulative housing as described above.

To decrease the weight of the LED illuminating apparatus, there has been proposed a technique for mounting a driver integrated circuit (IC) on the PCB of the light emitting module, connecting LEDs or light emitting cells or chips in the LEDs in reverse parallel, or integrating a bridge diode circuit in the light emitting module, other than omitting the SMPS for converting the AC current into the DC current. However, even when the SMPS is omitted from the LED illuminating apparatus, the core structure at the inner center of the heat sink exists as it is to accommodate the wire. This becomes an obstacle in reducing heat dissipation characteristics of the LED illuminating apparatus and decreasing the weight of the LED illuminating apparatus.

SUMMARY OF THE INVENTION

An object of the present invention is to provide a light emitting diode (LED) illuminating apparatus in which a wiring path is formed in an arbitrary heat dissipation fin provided to a heat sink by using an AC light emitting diode (LED) or LED AC driver circuit capable of being driven without a switching mode power supply (SMPS), so that it is possible to remove a core structure in the inner center of the heat sink of the conventional LED illuminating apparatus, to decrease the weight of the LED illuminating apparatus and to improve the heat dissipation performance of the LED illuminating apparatus.

According to an aspect of the present invention, there is provided an LED apparatus including: a heat sink having a plurality of heat dissipation fins; a light emitting module positioned on an upper portion of the heat sink; a power connection portion positioned below a lower portion of the heat sink; a translucent cover mounted to cover an upper portion of the light emitting module; and a wiring path formed in any corresponding one of the heat dissipation fins so as to accommodate a wire for electrically connecting the power connection portion and the light emitting module, wherein the light emitting module emits light by directly receiving AC power supplied through the wire accommodated in the wiring path.

The light emitting module may include a circuit board which has an electric wire for receiving AC power supplied through the wire; and an AC LED emitting light by receiving the AC power supplied through the electric wire.

The AC LED may include a first LED array having a plurality of LEDs connected in series to one another; and a second LED array having a plurality of LEDs connected in series to one another, and connected in reverse parallel to the first LED array having a different polarity therefrom.

The AC LED may include a first LED array having a plurality of LEDs connected to form a bridge circuit, and outputting a rectified power by receiving the AC power; and a second LED array having a plurality of LEDs connected in series to one another, and emitting light by receiving the rectified power applied from the first LED array.

The AC LED may include first to nth serial LED arrays (n is an even number greater than 2), which are mounted to the circuit board; and bridge portions connecting the first to nth serial LED arrays to one another. In the AC LED, output terminals of two bridge portions may be connected to each of input terminals of second to (n−1)th serial LED arrays disposed between the first serial LED array and the nth serial LED array. An input terminal of a first bridge portion of the two bridge portions may be connected to an output terminal of the preceding serial LED array, and an input terminal of a second bridge portion of the two bridge portions may be connected to an output terminal of the following serial LED array. An input terminal of the first serial LED array may be connected to an output terminal of the second serial LED array, and an input terminal of the nth serial LED array may be connected to an output terminal of the (n−1)th serial LED array.

The first to nth serial LED arrays may be arrayed in parallel with one another, and input and output terminals of the first to nth serial LED arrays may be positioned to be alternately changed from each other.

Each of the bridge portions may include at least one LED.

The AC LED may include first to nth serial LED arrays (n is an even number greater than 2), which are mounted to the circuit board; and bridge portions connecting the first to nth serial LED arrays to one another. In the AC LED, input terminals of two bridge portions may be connected to each of output terminals of second to (n−1)th serial LED arrays disposed between the first serial LED array and the nth serial LED array. An output terminal of a first bridge portion of the two bridge portions may be connected to an input terminal of the preceding serial LED array, and an output terminal of a second bridge portion of the two bridge portions may be connected to an input terminal of the following serial LED array. An output terminal of the first serial LED array may be connected to an input terminal of the second serial LED array, and an output terminal of the nth serial LED array may be connected to an input terminal of the (n−1)th serial LED array.

The first to nth serial LED arrays may be arrayed in parallel with one another, and input and output terminals of the first to nth serial LED arrays may be positioned to be alternately changed from each other.

Each of the bridge portions may include at least one LED.

An empty space may be formed inside inner corners of the heat dissipation fins.

The wiring path may have a hollow formed to be connected from a top end of the corresponding heat dissipation fin to a bottom ends thereof.

The wiring path may have a channel formed to be connected from a top end of the corresponding heat dissipation fin to a bottom end thereof.

A channel cover for covering an opening of the channel may be further provided to cover the wire passing through the channel.

The heat sink may have a heat dissipation plate integrally connected to an upper portion of the heat dissipation fins, and the circuit board may be mounted on the heat dissipation plate.

A wiring hole may be formed through the heat dissipation plate, and the wiring hole may be positioned at one side of a slot concavely formed from a top of the heat dissipation plate.

The heat dissipation plate may have a concave portion in which the circuit board is accommodated. A ring-shape frame portion may be formed along a top edge of the concave portion. A plurality of heat dissipation holes may be formed in the ring-shaped frame portion.

The translucent cover may be coupled to an upper portion of the heat sink, and the heat dissipation holes may be exposed to the outside of the translucent cover.

The power connection portion may have a socket base, and an insulator may be mounted between the socket base and the heat sink.

DETAILED DESCRIPTION OF THE ILLUSTRATED EMBODIMENTS

Figure 1:
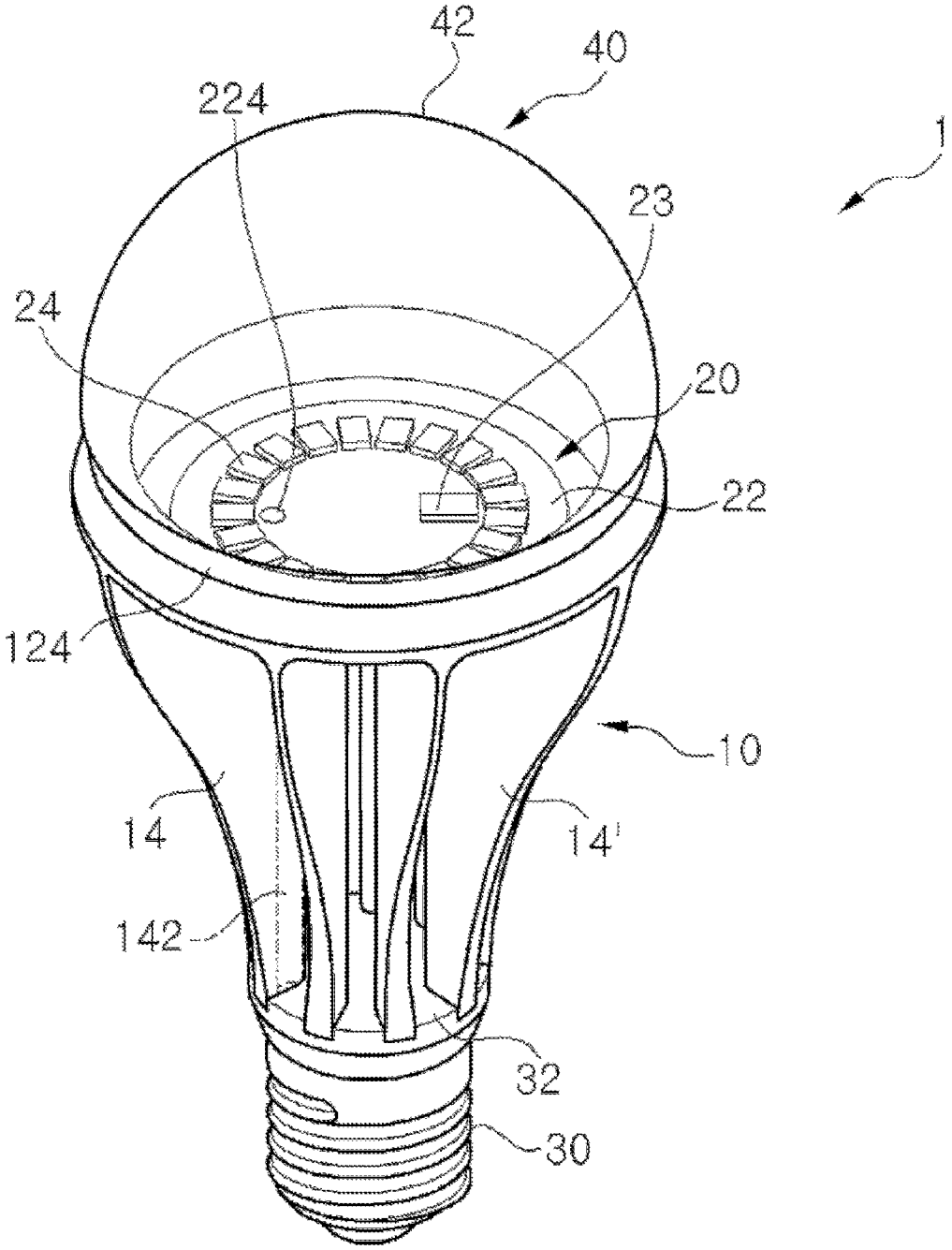
FIG. 1 is an assembled perspective view showing a light emitting diode (LED) illuminating apparatus using an AC LED according to an embodiment of the present invention.

Hereinafter, preferred embodiments of the present invention will be described in detail with reference to the accompanying drawings. The following embodiments are provided only for illustrative purposes so that those skilled in the art can fully understand the spirit of the present invention. Therefore, the present invention is not limited to the following embodiments but may be implemented in other forms. In the drawings, the widths, lengths, thicknesses and the like of elements are exaggerated for convenience of illustration. Like reference numerals indicate like elements throughout the specification and drawings.

In this specification, the term "AC light emitting diode (LED)" is a concept including all kinds of light emitting cells, LED devices, LED packages, LED chips, LED arrays and the like, which can emit light by directly receiving AC power (Vin). Hereinafter, for convenience of illustration and understanding, an LED device configured to emit light by directly receiving the AC power (Vin) will be described, but the present invention is not limited thereto.

Figure 2:
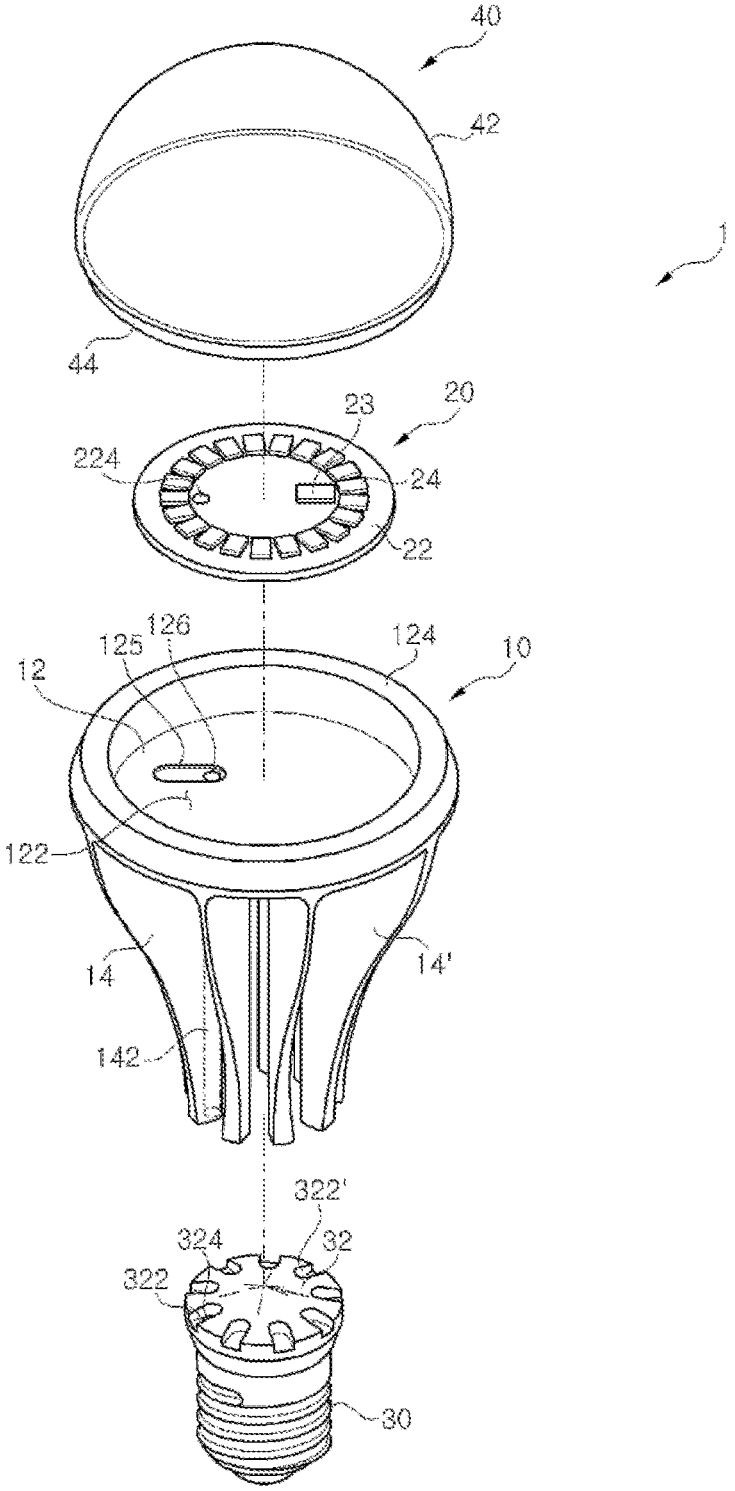
FIG. 2 is an exploded perspective view showing the LED illuminating apparatus using the AC LED shown in FIG. 1.

FIG. 1 is an assembled perspective view showing an LED illuminating apparatus using an AC LED according to an embodiment of the present invention. FIG. 2 is an exploded perspective view showing the LED illuminating apparatus using the AC LED shown in FIG. 1.

Figure 3:
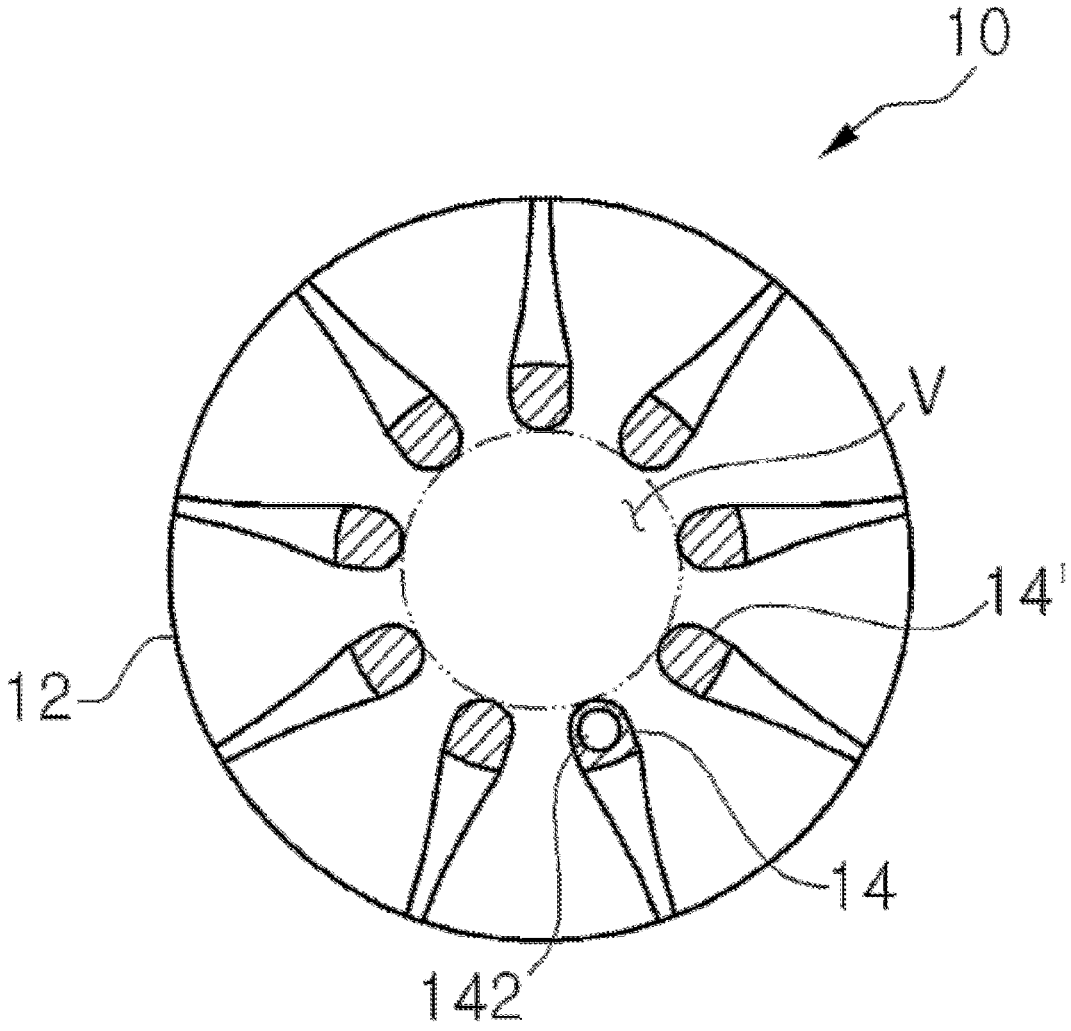
FIG. 3 is a bottom view showing a bottom surface of a heat sink of the LED illuminating apparatus using the AC LED shown in FIGS. 1 and 2.

FIG. 3 is a bottom view showing a bottom surface of a heat sink of the LED illuminating apparatus using the AC LED shown in FIGS. 1 and 2.

As shown in FIGS. 1 and 2, an LED illuminating apparatus 1 according to this embodiment generally has a form of an incandescent lamp. The LED illuminating apparatus 1 includes a heat sink 10, a light emitting module 20 positioned on an upper portion of the heat sink 10, a power connection portion 30 positioned below a lower portion of the heat sink 10, and a translucent cover 40 mounted to cover the light emitting module 20. The power connection portion 30 has an insulator 32 for ensuring electrical insulation from the heat sink 10, provided on an upper portion of the power connection portion 30 or between the heat sink 10 and the power connection portion 30.

As well shown in FIG. 2, the heat sink 10 is formed by metal casting or die-casting, and includes a heat dissipation plate 12 and a plurality of heat dissipation fins 14 and 14' integrally formed with the heat dissipation plate 12 on a bottom surface of the heat dissipation plate 12. The plurality of heat dissipation fins 14 and 14' are approximately radially formed on the bottom surface of the heat dissipation plate 12, and are extended lengthwise toward a lower portion of the LED illuminating apparatus 1, at which the power connection portion 30 is positioned. The heat dissipation plate 12 includes a concave portion 122 and a ring-shaped frame portion 124 formed along a top edge of the concave portion 122.

A wiring path 142 is formed in one heat dissipation fin 14 of the plurality of heat dissipation fins 14 and 14'. The wiring path 142 is formed by a hollow connected from a top end of the corresponding heat dissipation fin 14 to a bottom end thereof. As shown in these figures, only the heat dissipation fin 14 having the wiring path 142 may be formed to have the hollow structure, but the other heat dissipation fins 14' may include the hollow structure through which any wire (not shown) does not pass.

Meanwhile, a wiring hole 126 is formed through the heat dissipation plate 12. The wiring hole 126 is positioned inside the concave portion 122 of the heat dissipation plate 12. The wiring hole 126 is positioned at one side of a slot 125 formed to be long and concave in a bottom surface of the concave portion 122 of the heat dissipation plate 12. The slot 125 maintains a portion of the wire passing through the wiring hole 126 to be horizontal or inclined, so as to prevent the wire from being directly and vertically connected to the light emitting module 20, and accordingly, being easily separated from the light emitting module 20. The depth of the slot 125 is preferably identical to or greater than the thickness of the wire.

Referring to FIG. 3, it can be seen that an approximately circular center region or space v confined by inner corners of the heat dissipation fins 14 and 14', i.e., confined by a virtual line obtained by connecting the inner corners to one another, is completely empty. In case of the conventional LED illuminating apparatus, a core structure for covering a switching mode power supply (SMPS) and a wire is positioned in the center region or space, which deteriorates the flow of heat at the center of the heat sink 10, i.e., in the vicinity of the inner corners of the heat dissipation fins. Therefore, heat dissipation is mainly made only at outer corners of the heat dissipation fins so that the heat dissipation performance of the heat sink 10 might be lowered.

Meanwhile, according to this embodiment, the conventional SMPS and the components for covering the SMPS are removed in the center region of the heat sink 10, so that it is possible to decrease the weight of the LED illuminating apparatus. In this embodiment, each of the inner corners of the heat dissipation fins 14 and 14' may have a straight line shape, and each of the outer corners of the heat dissipation fins 14 and 14' may have an approximately streamline shape.

Referring back to FIG. 2, the light emitting module 20 includes a circular printed circuit board (PCB) 22 and LEDs 24 mounted in an approximately circular arrangement on the PCB 22. The light emitting module 20 is mounted on the heat dissipation plate 12 of the heat sink 10 so that the PCB 22 is at least partially accommodated in the concave portion 122.

Meanwhile, the light emitting module 20 according to the present invention is configured to be operated by receiving AC power applied without the SMPS. To this end, according to one embodiment, each of the LEDs 24 in the light emitting module 20 may be arrayed in the form of emitting light by directly receiving AC power (Vin), i.e., to form an AC LED, so that the LED 24 may be mounted on the PCB 22. The light emitting module 20 and the AC LED according to the present invention will be described later with reference to FIGS. 6 to 9.

According to another embodiment, the light emitting module 20 may further include a driver integrated circuit (IC) 23 on the PCB 22. The driver IC 23 enables the LEDs 24 mounted on the PCB 22 to be AC-driven while being positioned inside the arrangement of the LEDs 24. Each of the plurality of LEDs 24 may be an LED package having an LED chip included therein or an LED chip directly mounted the PCB 22. The driver IC 23 enables the implementation of the LED illuminating apparatus without the SMPS, and accordingly, enables the omission of the core structure, which should have been provided at the center of the heat sink 10 to accommodate the SMPS and the wire. The LEDs may be AC-driven using a circuit structure in which LEDs in a light emitting module or light emitting cells or light emitting chips in an LED are connected in reverse parallel to one another or using a bridge diode circuit instead of the driver IC 23 or together with the driver IC 23. Accordingly, it is possible to omit the SMPS. The driver IC, the circuit in which the LEDs are connected in reverse parallel to one another, the circuit in which the light emitting chips or light emitting cells in the LED are connected in reverse parallel to one another, or the bridge diode circuit as described above belong to the circuit which enables the LEDs to be AC-driven, so that such a circuit is defined as an 'AC driver circuit.' The light emitting module 20 and the driver IC 23 included therein, according to the present invention as described above, will be described later with reference to FIGS. 10 to 12.

A wiring hole 224 is formed through the PCB 22. At this time, the slot 125 of the heat dissipation plate 12 is formed to have an area larger than that of the wiring hole 224 at a position corresponding to the wiring hole 224, and the wiring hole 126 in the slot 125 and the wiring hole 224 are preferably dislocated from each other. The wire approximately vertically passing through the wiring hole 126 of the heat dissipation plate 12 is connected on the PCB 22 by passing through the wiring hole 224 of the PCB 22 while a portion of the wire is supported by the bottom surface of the horizontal or inclined slot 125.

The translucent cover 40 includes a lens portion 42 and a lens coupling portion 44 formed at a bottom end of the lens portion 42. The lens portion 42 approximately has a bulb shape. The lens portion 42 may also include a light diffusion pattern or a light diffusing agent. The lens portion 42 may further include a remote phosphor. The lens coupling portion 44 is inserted into the inside of the concave portion 122, so that the translucent cover 40 can cover the concave portion 122 of the heat dissipation plate 12, on which the light emitting module 20 is positioned, while the translucent cover 40 exposes the top end frame portion 124 of the heat dissipation plate 12 to the outside. The top end frame portion 124 of the heat dissipation plate 12 is exposed to the outside, so that the heat dissipation performance of the heat sink 10 can be improved. When a heat dissipation hole which allows air to flow smoothly is formed through the frame portion 124, the heat dissipation performance of the heat sink 10 can be further improved.

As described above, the power connection portion 30 is positioned below the lower portion of the heat sink 10. The power connection portion 30 may include a socket base. The power connection portion 30 has the insulator 32 for ensuring electrical insulation from the heat sink 10, provided on the upper portion of the power connection portion 30 or between the heat sink 10 and the power connection portion 30. In this embodiment, the insulator 32 is made of a ceramic material having an excellent heat dissipation performance as well as an electrical insulation property.

The insulator 32 has grooves 322 and 322' into which bottom ends of the leg-shaped heat dissipation fins 14 and 14' extended downward are inserted, respectively. One groove 322 of the grooves 322 and 322' is provided to correspond to the heat dissipation fin 14 having the wiring path 142 formed therein, and a wiring hole 324 for guiding the wire to the power connection portion 30 is formed through the groove 322. The heat dissipation fins 14 and 14' respectively inserted into the grooves 322 and 322' are connected to the insulator 32 by means of an adhesive or a fastener.

The power connection portion 30 is coupled to a lower portion of the insulator 32 while having the structure of the socket base.

Figure 4:
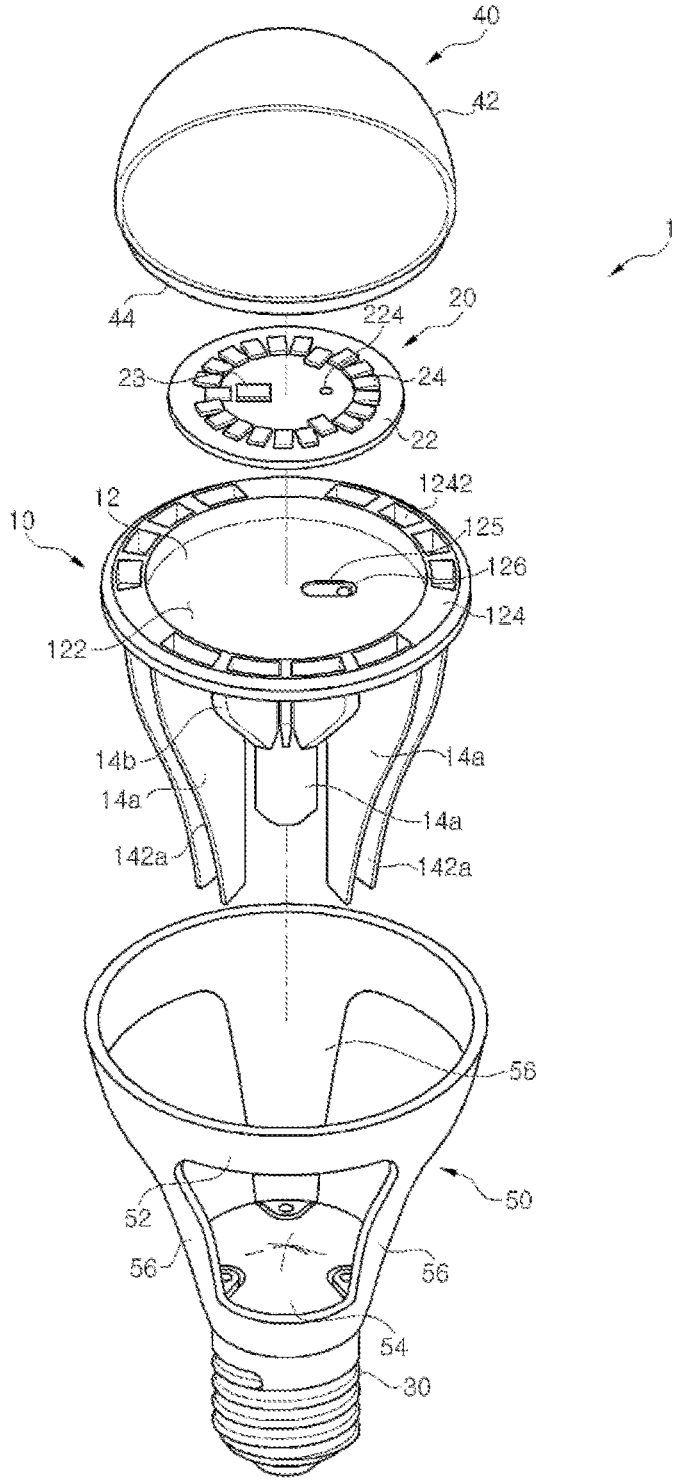
FIG. 4 is an exploded perspective view showing an LED illuminating apparatus using an AC LED according to another embodiment of the present invention.

FIG. 4 is an exploded perspective view showing an LED illuminating apparatus using an AC LED according to another embodiment of the present invention.

Referring to FIG. 4, the LED illuminating apparatus 1 according to this embodiment includes a heat sink 10 as in the aforementioned embodiment, and the heat sink 10 includes a heat dissipation plate 12 and a plurality of leg-shaped heat dissipation fins 14*a* and 14*b* extended from a top end to a bottom end thereof while being radially formed on a bottom surface of the heat dissipation plate 12. One or more heat dissipation fins 14*a* of the plurality of heat dissipation fins 14*a* and 14*b* has a channel structure including a channel 142*a*. The other heat dissipation fins 14*b* have a solid structure or a single-plate structure.

In this embodiment, each of three heat dissipation fins 14*a* has a channel 142*a*, and a wiring path is formed in one of the channels 142*a*. Each of the channels 142*a* has a structure opened toward the outer direction thereof. The heat dissipation fins 14*a* having their respective channels are spaced apart from each other at a predetermined angle, and one or more heat dissipation fins 14*b* having no channel are positioned between two neighboring heat dissipation fins 14*a* having their respective channels.

Meanwhile, the LED illuminating apparatus 1 according to this embodiment further includes an assembly-type insulating housing 50, and the assembly-type insulating housing 50 includes a ring-shaped side holding portion 52 coupled to a top circumference of the heat sink 10 so as to surround the top circumference, and a support portion 54 on which a bottom end of the heat sink 10, i.e., bottom ends of the heat dissipation fins 14*a* and 14*b* are mounted. Since the support portion 54 is positioned between the power connection portion 30 and the heat dissipation fins of the heat sink, the support portion 54 may serve to insulate the heat sink 10 and the power connection portion 30 from one another, as in the insulator of the aforementioned embodiment.

The insulating housing 50 includes three channel covers 56, and the channel covers 56 are provided to correspond to the respective channels 142*a* of the respective heat dissipation fins 14*a* so as to cover openings of the respective channels 142*a*. Accordingly, the insides of the channels 142*a* are covered by the respective channel covers 56, and a wire that may exist in one of the channels 142*a* is also covered by one of the channel covers 56. The support portion 54 is configured to include a structure including grooves or holes, by which the heat dissipation fins 14*a* can be easily coupled to the power connection portion 30, and a hole for guiding the wire, passing through the channel 142*a* of a specific heat dissipation fin 14*a*, to the power connection portion 30.

Meanwhile, according to this embodiment, a plurality of heat dissipation holes 1242 allowing air to flow smoothly are formed through a top end frame portion 124 of the heat sink 10. The translucent cover 40 includes a lens portion 42 and a lens coupling portion 44 formed at a bottom end thereof. At this time, the lens coupling portion 44 is inserted into a concave portion 122, so that the top end frame portion 124 of the heat sink 10 and the plurality of heat dissipation holes 1242 formed through the top end frame portion 124 are not covered by the translucent cover 40 but are exposed to the outside. As described above, the top end frame portion 124 of the heat sink 10 and the heat dissipation holes 1242 are exposed to the outside, so that the heat dissipation performance of the heat sink 10 can be further improved.

The other components of this embodiment are substantially identical or almost similar to those of the aforementioned embodiment, and therefore, their descriptions will be omitted to avoid redundancy.

Figure 5:
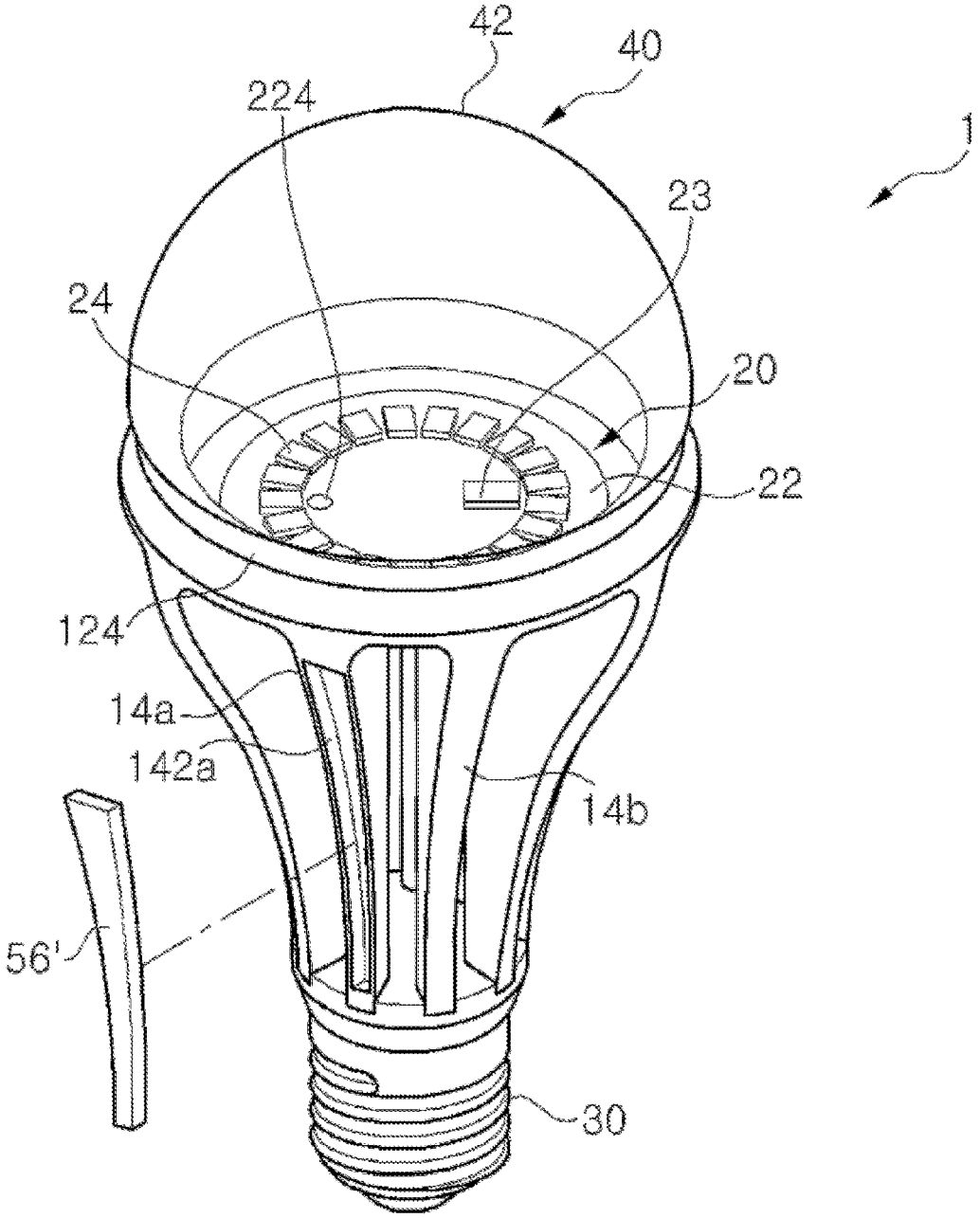
FIG. 5 is a perspective view showing an LED illuminating apparatus using an AC LED according to a further embodiment of the present invention.

FIG. 5 is a perspective view showing an LED illuminating apparatus using an AC LED according to a further embodiment of the present invention.

Referring to FIG. 5, the LED illuminating apparatus 1 according to this embodiment includes an assembly-type channel cover 56' independently and separately covering a channel 142*a* of a heat dissipation fin 14*a*, which serves as a wiring path, instead of omitting the assembly-type insulating housing of the aforementioned embodiment. The assembly-type channel cover 56' is coupled to a channel opening of the corresponding heat dissipation fin 14*a* by a fastener or an adhesive. A wire passing through the channel 142*a* of the corresponding heat dissipation fin 14*a* is covered by the channel cover 56'.

Hereinafter, various embodiments of an AC LED included in the light emitting module 20 according to the present invention will be described with reference to FIGS. 6 to 9, respectively.

Figure 6:
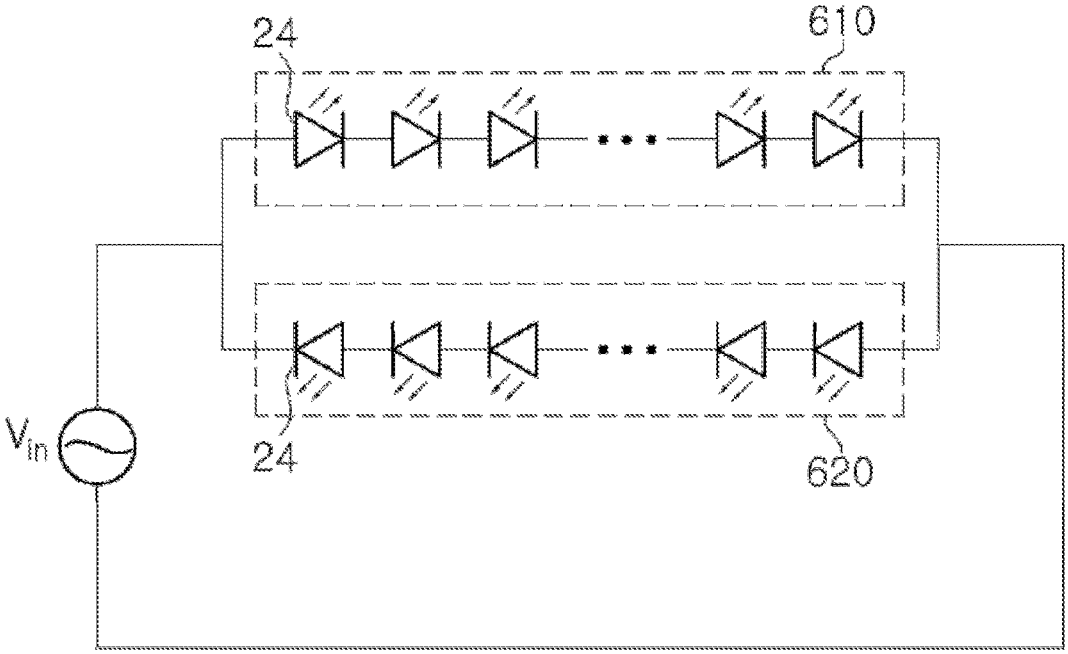
FIG. 6 is an equivalent circuit diagram of a light emitting module according to an embodiment of the present invention.

First, FIG. 6 is an equivalent circuit diagram of an AC LED included in the light emitting module 20 of the LED illuminating apparatus according to an embodiment of the present invention. The AC LED shown in FIG. 6 has the configuration of the simplest form of an AC LED, and the configuration and function of the AC LED according to this embodiment will be described in detail with reference to FIG. 6.

Referring to FIG. 6, the AC LED included in the light emitting module 20 according to this embodiment may include a first LED array 610 mounted on the PCB 22 and a second LED array 620 mounted in reverse parallel to the aforementioned first LED array 610 on the PCB. As shown in this figure, each of the first and second LED arrays 610 and 620 may include a plurality of LEDs 24 connected in series to one another. That is, to alternately use an AC voltage applied by being directly connected to an AC power source Vin for illuminating purposes, the first and second LED arrays 610 and 620 according to this embodiment are connected in parallel with opposite polarities to each other. As a result, if the AC power Vin is applied to the AC LED, for example, the first LED array 610 emits light during one positive half period and the second LED array 620 emits light during the other negative half period. Thus, the AC LED according to this embodiment can emit light regardless of the change in polarity of the AC power Vin, so as to be operated by directly receiving the AC power Vin.

Figure 7:
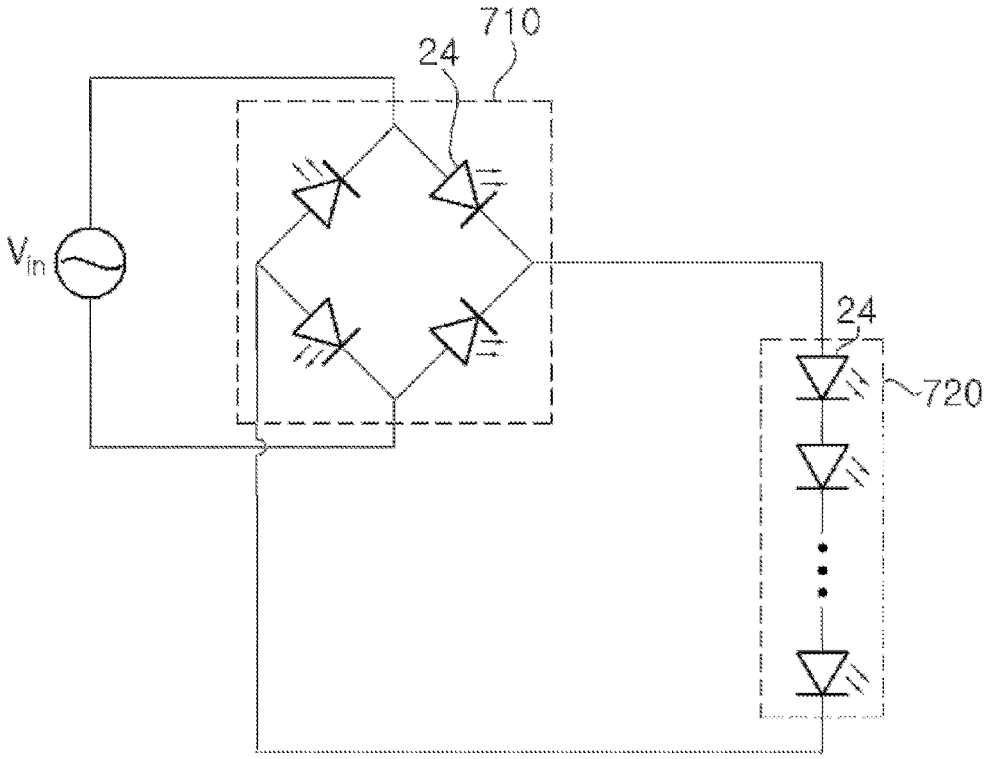
FIG. 7 is an equivalent circuit diagram of a light emitting module according to another embodiment of the present invention.

FIG. 7 is an equivalent circuit diagram of an AC LED included in the light emitting module 20 according to another embodiment of the present invention. In case of the AC LED described above with reference to FIG. 6, half of the total LEDs alternately emit light during the application of the AC power Vin, and hence, there is a disadvantage in that the light emitting efficiency becomes lower and the number of LEDs required to obtain a desired intensity of illumination should be increased. The AC LED conceived to solve such a disadvantage is shown in FIG. 7.

As shown in FIG. 7, the AC LED according to this embodiment may include first and second LED arrays 710 and 720 mounted on the PCB 22. The AC LED shown in FIG. 7 is used to be applied to the AC power Vin. In the AC LED, LEDs in the first LED array 710 are configured in the form of a bridge circuit to perform a rectification operation, thereby improving the light emitting efficiency.

Referring to FIG. 7, the AC LED according to this embodiment includes the second LED array 720 having a plurality of LEDs 24 connected in series to each other and the first LED array 710 having a plurality of LEDs 24 connected in the form of a bridge circuit. As shown in this figure, the first and second LED arrays 710 and 720 are connected in series to each other, and an AC voltage is applied to the first LED array 710 from the AC power source Vin.

The first LED array 710 includes at least four LEDs 24 configured in the form of a bridge circuit. Only one LED 24 may be disposed on each side of the bridge circuit, or a plurality of LEDs may be connected in series to each other on each side of the bridge circuit. The first LED array 710 having the LEDs 24 arrayed in the form of the bridge circuit performs the full-wave rectification on the applied AC power Vin so that the first LED array 710 outputs the rectified power to the second LED array 720. At the same time, since the first LED array 710 itself has all the characteristics of the LED, the first LED array 710 emits light when the forward current flows through the first LED array 710.

The second LED array 720 may include a plurality of LEDs 24 connected in series to one another, and is configured to emit light by being connected in series to an output terminal of the first LED array 710 and receiving the rectified power which is output from the first LED array 710.

An operation of the AC LED according to this embodiment configured as described above will be described as follows. First, while a current flows through two LEDs of the four LEDs included in the first LED array 710 during a positive half period of the AC power Vin, another current flows through the other two LEDs of the four LEDs included in the first LED array 710 during a negative half period of the AC power Vin. As a result, a half of the total number of the LEDs included in the first LED array 710 alternately emits light. Meanwhile, since the second LED array 720 receives the full-wave rectified power applied from the first LED array 710, the whole LEDs in the second LED array 720 continuously emit light regardless of the period of the AC power Vin. Thus, the light emitting efficiency of the AC LED according to this embodiment is improved as compared with the conventional AC LED having a reverse parallel structure.

Figure 8A:
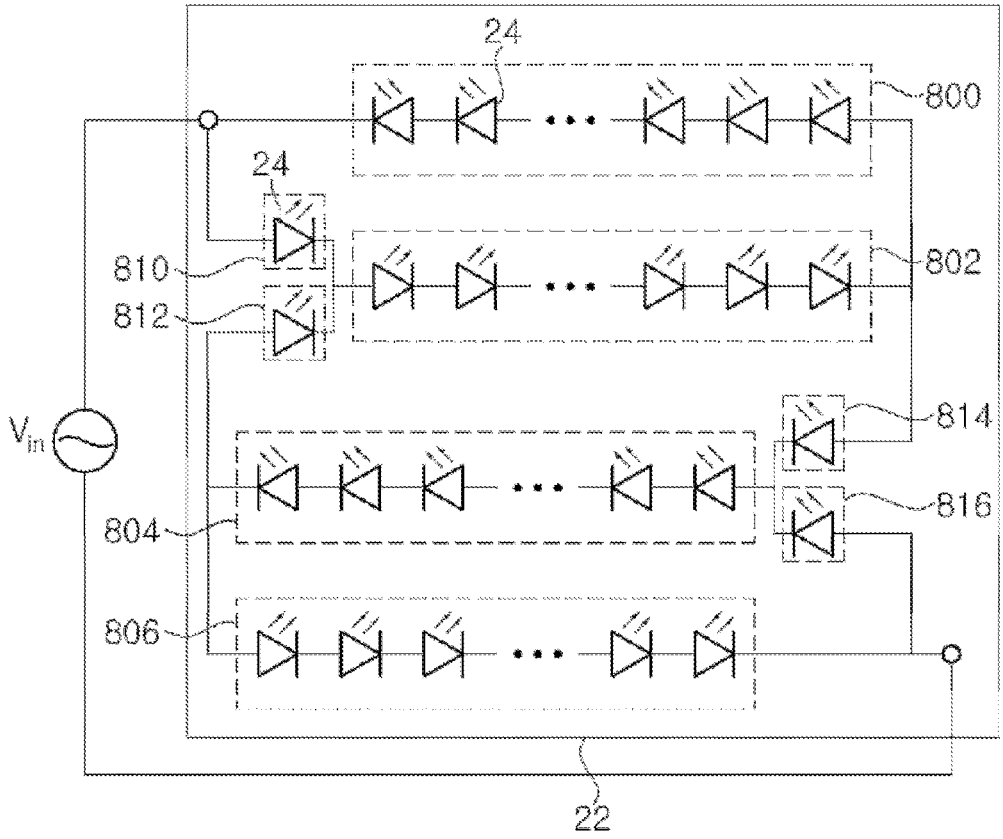
FIG. 8A is an equivalent circuit diagram of a light emitting module according to a further embodiment of the present invention.

FIG. 8A is an equivalent circuit diagram of an AC LED included in the light emitting module 20 according to a further embodiment of the present invention.

As shown in FIG. 8A, the AC LED according to this embodiment includes first to fourth serial LED arrays 800, 802, 804 and 806 arrayed on a circuit board 22, and bridge portions 810, 812, 814 and 816 connecting the first to fourth serial LED arrays 800, 802, 804 and 806 to one another. As shown in this figure, each of the first to fourth serial LED arrays 800, 802, 804 and 806 includes a plurality of LEDs connected in series to one another. Each of the bridge portions 810, 812, 814 and 816 includes at least one LED 24.

Preferably, the first to fourth serial arrays are arrayed in parallel with one another, and input and output terminals of the first to fourth serial LED arrays are positioned to be alternately changed from each other as shown in this figure.

Meanwhile, output terminals of two bridge portions 810 and 812; or 814 and 816 are connected to each input terminal of the second and third serial LED arrays 802 and 804 disposed between the first and fourth serial LED arrays 800 and 806. An input terminal of a first bridge portion 810 or 814 of the two bridge portions is connected to an output terminal of the preceding serial LED array 800 or 802, and an input terminal of a second bridge portion 812 or 816 of the two bridge portions is connected to an output terminal of the following serial LED array 804 or 806.

That is, the output terminals of the first and second bridge portions 810 and 812 are connected to the input terminal of the second serial LED array 802, the input terminal of the first bridge portion 810 is connected to the output terminal of the first serial LED array 800, and the input terminal of the second bridge portion 812 is connected to the output terminal of the third serial LED array 804. Further, the output terminals of the first and second bridge portions 814 and 816 are connected to the input terminal of the third serial LED array 804, the input terminal of the first bridge portion 814 is connected to the output terminal of the second serial LED array 802, and the input terminal of the second bridge portion 816 is connected to the output terminal of the fourth serial LED array 806.

Meanwhile, an input terminal of the first serial LED array 800 is connected to the output terminal of the second serial LED array 802, and an input terminal of the fourth serial LED array 806 is connected to the output terminal of the third serial LED array 804.

The operation of the AC LED according to this embodiment configured as described above will be described. First, a current flows through the first bridge portion 810, the second serial LED array 802, the first bridge portion 814, the third serial LED array 804, and the fourth LED array 806 during a half period in which the AC power source Vin is connected to the AC LED so that a forward current flows in the first bridge portion 810. Thus, the LEDs in the second, third and fourth serial LED arrays 802, 804 and 806 are driven.

Next, a current flows through the second bridge portion 816, the third serial LED array 804, the second bridge portion 812, the second serial LED array 802, and the first serial LED array 800 during another half period in which the voltage application direction of the AC power source Vin is changed so that a forward current flows in the second bridge portion 816. Thus, the LEDs in the first, second and third serial LED arrays 800, 802 and 804 are driven.

Accordingly, in the AC LED according to this embodiment, the same number of serial LED arrays and LEDs as the conventional AC LED using six serial LED arrays can be driven using only four serial LED arrays, thereby improving the light emitting efficiency of the AC LED.

Meanwhile, in this embodiment, it has been illustrated that the four serial LED arrays arrayed so that their polarities are alternately changed on the single PCB 22 are connected using the bridge portions. However, if the serial LED arrays are configured as four or more even-numbered serial LED arrays arrayed so that their polarities are alternately changed, the number of serial LED arrays is not particularly limited.

When the number of serial LED arrays is n>4, output terminals of two bridge portions are connected to each input terminal of second to (n−1)th serial LED arrays disposed between first and nth serial LED arrays, an input terminal of a first bridge portion of the two bridge portions is connected to an output terminal of the preceding serial LED array, and an input terminal of a second bridge portion of the two bridge portions is connected to an output terminal of the following serial LED array. Further, an input terminal of the first serial LED array is connected to an output terminal of the second serial LED array, and an input terminal of the nth serial LED array is connected to an output of the (n−1)th serial LED array.

Figure 8B:
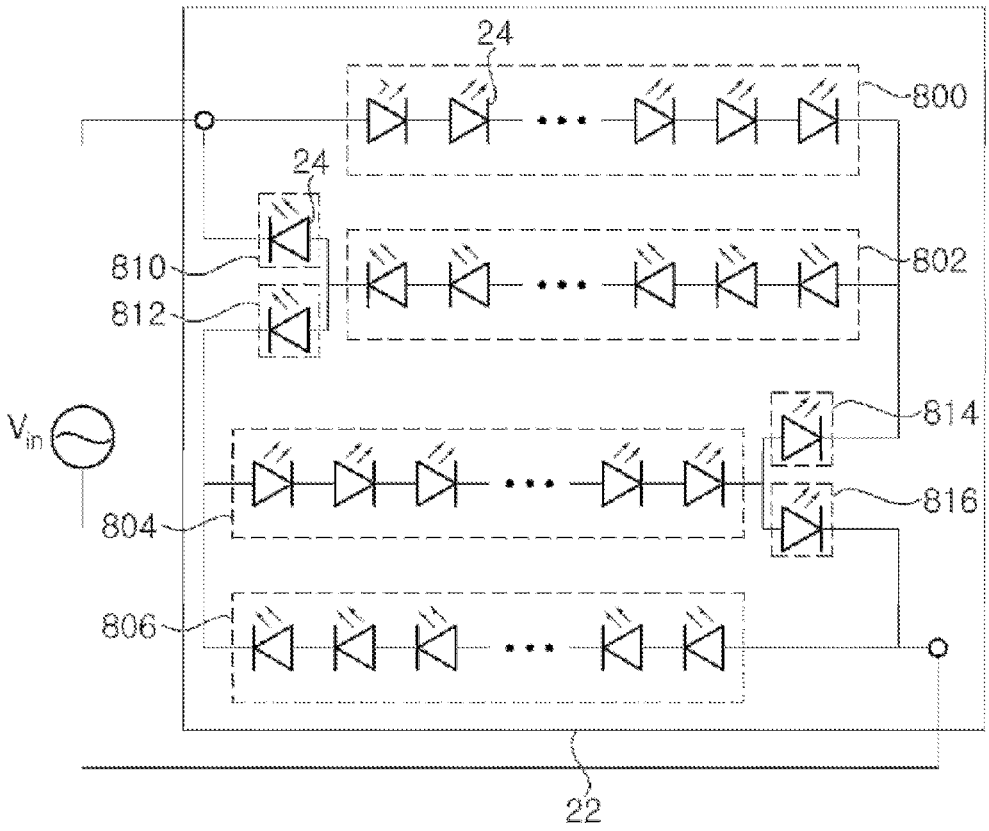
FIG. 8B is an equivalent circuit diagram of a light emitting module according to a still further embodiment of the present invention.

FIG. 8B is an equivalent circuit diagram of an AC LED included in the light emitting module 20 according to a still further embodiment of the present invention.

As shown in FIG. 8B, the AC LED according to this embodiment includes first to fourth serial LED arrays 800, 802, 804 and 806 arrayed on a circuit board 22, and bridge portions 810, 812, 814 and 816 connecting the first to fourth serial LED arrays 800, 802, 804 and 806 to one another. As shown in this figure, each of the first to fourth serial LED arrays 800, 802, 804 and 806 includes a plurality of LEDs connected in series to one another. Further, each of the bridge portions 810, 812, 814 and 816 includes at least one LED 24.

However, the AC LED according to this embodiment is different from the AC LED described with reference to FIG. 8A in that both the polarity directions of the LEDs 24 in the first to fourth serial LED arrays 800, 802, 804 and 806 and the polarity directions of the LEDs 24 in the bridge portions 810, 812, 814 and 816 are arranged in opposite directions.

Input terminals of two bridge portions 810 and 812; or 814 and 816 are connected to each output terminal of the second and third serial LED arrays 802 and 804 disposed between the first and fourth serial LEDs 800 and 806. An output terminal of a first bridge portion 810 or 814 of the two bridge portions is connected to an input terminal of the preceding serial LED array 800 or 802, and an output terminal of a second bridge portion 812 or 816 of the two bridge portions is connected an input terminal of the following serial LED array 804 or 806.

That is, the input terminals of the first and second bridge portions 810 and 812 are connected to the output terminal of the second serial LED array 802, the output terminal of the first bridge portion 810 is connected to the input terminal of the first serial LED array 800, and the output terminal of the second bridge portion 812 is connected to the input terminal of the third serial LED array 804. Further, the input terminals of the first and second bridge portions 814 and 816 are connected to the output terminal of the third serial LED array 804, the output terminal of the first bridge portion 814 is connected to the input terminal of the second serial LED array 802, and the output terminal of the second bridge portion 816 is connected to the input terminal of the fourth serial LED array 806.

Meanwhile, an output terminal of the first serial LED array 800 is connected to the input terminal of the second serial LED array 802, and an output terminal of the fourth serial LED array 806 is connected to the input terminal of the third serial LED array 804.

An operation of the AC LED according to this embodiment configured as described above will be described. First, a current flows through the first serial LED array 800, the second serial LED array 802, the second bridge portion 812, the third serial LED array 804, and the second bridge portion 816 during a half period in which the AC power source Vin is connected to the AC LED so that a forward current flows in the first serial LED array 800. Thus, the LEDs in the first, second and third serial LED arrays 800, 802 and 804 are driven.

Next, a current flows through the fourth serial LED array 806, the third serial LED array 804, the first bridge portion 814, the second serial LED array 802, and the first bridge portion 810 during another half period in which the voltage application direction of the AC power source Vin is changed so that a forward current flows in the fourth serial LED array 806. Thus, the LEDs in the second, third and fourth serial LED arrays 802, 804 and 806 are driven.

Accordingly, in the AC LED according to this embodiment, the same number of serial LED arrays and LEDs as the conventional AC LED using six serial LED arrays can be driven using only four serial LED arrays, thereby improving the light emitting efficiency of the AC LED.

Meanwhile, in this embodiment, it has been illustrated that the four serial LED arrays arrayed so that their polarities are alternately changed on the single PCB 22 are connected using the bridge portions. However, if the serial LED arrays are configured as four or more even-numbered serial LED arrays arrayed so that their polarities are alternately changed, the number of serial LED arrays is not particularly limited.

When the number of serial LED arrays is n>4, input terminals of two bridge portions are connected to each output terminal of second to (n−1)th serial LED arrays disposed between first and nth serial LED arrays, an output terminal of a first bridge portion of the two bridge portions is connected to an input terminal of the preceding serial LED array, and an output terminal of a second bridge portion of the two bridge portions is connected to an input terminal of the following serial LED array. Further, an output terminal of the first serial LED array is connected to an input terminal of the second serial LED array, and an output terminal of the nth serial LED array is connected to an input terminal of the (n−1)th serial LED array.

Figure 9:
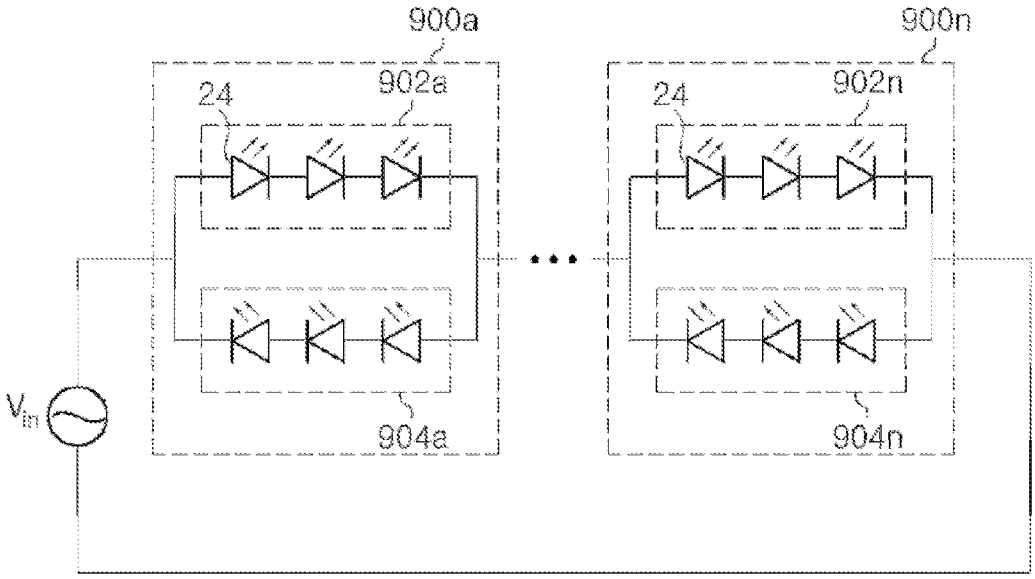
FIG. 9 is an equivalent circuit diagram of a light emitting module according to a still further embodiment of the present invention.

FIG. 9 is an equivalent circuit diagram of a light emitting module according to a further embodiment of the present invention.

The light emitting module 20 shown in FIG. 9 includes a plurality of AC LED packages 900*a* to 900*n* connected in series to one another, which can be driven by directly receiving AC power applied from an AC power source Vin. Each of the AC LED packages 900*a* to 900*n* includes a first light emitting cell array 902 including a plurality of light emitting cells 24 connected in series to one another, and a second light emitting cell array 904 including a plurality of light emitting cells 24 connected in series to one another, wherein the second light emitting cell array 904 is connected in reverse parallel to the first light emitting cell array 902. Thus, the first light emitting cell array 902 emits light during one half period of the AC power Vin and the second light emitting cell array 904 emits light during the other half period of the AC power Vin, so that the AC LED package 900 according to this embodiment can emit light by directly receiving the AC power Vin. Meanwhile, the AC LED package 900 according to this embodiment may be fabricated at a wafer level. Hereinafter, the fabricating process of the AC LED package 900 according to this embodiment will be described. First, a plurality of light emitting cells 24 are formed on a substrate (not shown). Each of the light emitting cells 24 includes a lower semiconductor layer (not shown), an active layer (not shown) formed on a portion of the lower semiconductor layer, and an upper semiconductor layer (not shown) formed on the active layer. Meanwhile, a buffer layer (not shown) may be interposed between the substrate and the light emitting cells 24, and GaN or AlN may be mainly used for the buffer layer. The lower and upper semiconductor layers may be n-type and p-type semiconductor layers, respectively. Alternatively, the lower and upper semiconductor layers may be p-type and n-type semiconductor layers, respectively. The active layer may have a single and multiple quantum well structure. A first electrode (not shown) may be formed at a portion except another portion at which the active layer of the lower semiconductor layer is formed, and a second electrode (not shown) may be formed on the upper semiconductor layer. In the light emitting cells 24, the lower semiconductor layer of one light emitting cell is connected to the upper semiconductor layer of another light emitting cell adjacent to the one light emitting cell using a wire (not shown). At least one first light emitting cell array 902 and at least one second light emitting cell array 904, which are connected in series to each other, are formed, and then the first and second light emitting cell arrays 902 and 904 manufactured as described above are connected in reverse parallel to each other, so that the AC LED package 900 can be used by being directly connected to the AC power source Vin. At this time, the wire may be formed using a typical process such as a step cover process or an air bridge process, but the present invention is not limited thereto.

Hereinafter, various embodiments of an AC driver circuit included in the light emitting module 20 according to the present invention will be described with reference to FIGS. 10 to 12, respectively.

Figure 10:
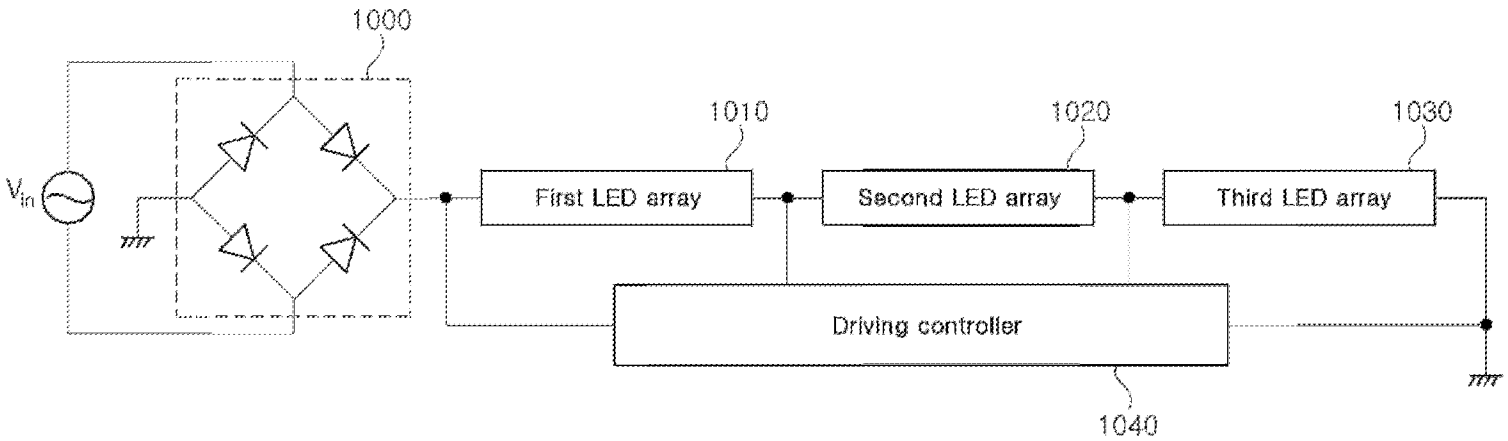
FIG. 10 is a configuration block diagram of an LED AC driver circuit according to an embodiment of the present invention.

FIG. 10 is a configuration block diagram of an LED AC driver circuit according to an embodiment of the present invention.

As shown in FIG. 10, the LED AC driver circuit may include a rectifier 100, a first LED array 1010, a second LED array 1020, a third LED array 1030 and a driving controller 1040.

For convenience of illustration and understanding, three LED arrays, i.e., the first to third LED arrays 1010 to 1030 have been illustrated in this figure, but it will be apparent by those skilled in the art that two or more LED arrays may be employed as occasion demands within the technical scope of the present invention.

Meanwhile, the driver IC 23 described with reference to FIG. 2 may be implemented by integrating the rectifier 1000 and the driving controller 1040 in a single chip. The technique for implementing the driving IC 23 by integrating a plurality of electronic devices and electronic circuits in the single chip is, in itself, a previously known technique, and therefore, its detailed description will be omitted.

First, as shown in this figure, the rectifier 1000 according to this embodiment is configured to perform a function of full-wave rectifying AC power Vin applied from an AC power source and supplying the rectified power. The rectifier 1000 may be configured by connecting four diodes to one another to form a bridge circuit as shown in this figure. In addition, one of various rectifiers known in the art may be employed as the occasion demands. The four diodes constituting the rectifier 1000 may be implemented as LEDs based on various embodiments of the present invention.

Each of the first to third LED arrays 1010 to 1030 includes a plurality of LEDs 24 connected in series to one another, and the first to third LED arrays are connected in series to one another. The first to third LED arrays 1010 to 1030 is controlled by the driving controller 1040 so as to emit light by selectively receiving the rectified power which is output from the rectifier 1000.

The driving controller 1040 is connected to an output terminal of the rectifier 1000, and configured to perform a function of controlling the operations of the first to third LED arrays 1010 to 1030 by determining a voltage level of the rectified power which is input from the output terminal of the rectifier 1000, and selectively supplying/cutting off the rectified power to/from the first to third LED arrays 1010 to 1030 according to the determined voltage level.

That is, using the characteristics of the rectified power of which voltage level is periodically changed based on time, the driving controller 1040 controls one of the three LED arrays to emit light by supplying the rectified power to the one LED array when it is determined that the voltage level of the rectified power correspond to 1 VF (i.e., a forward voltage level capable of driving one LED array) (i.e., 1 VF≤ the voltage level of the rectified power <2 VF). The driving controller 1040 controls two of the three LED arrays to emit light by supplying the rectified power to the two LED arrays when it is determined that the voltage level of the rectified power increases from 1 VF to 2 VF (i.e., 2 VF≤ the voltage level of the rectified power <3 VF). The driving controller 1040 controls all the three LED arrays to emit light by supplying the rectified power to all the three LED arrays when it is determined that the voltage level of the rectified power increases from 2 VF to 3 VF (i.e., 3 VF≤ the voltage level of the rectified power).

Similarly, the driving controller 1040 according to this embodiment is configured to control only two LED arrays to emit light by cutting off the supply of the rectified power to one of the three LED arrays when it is determined that the voltage level of the rectified power decreases from 3 VF to 2 VF (i.e., 2 VF≤ the voltage level of the rectified power <3 VF). The driving controller 1040 is configured to control only one LED array to emit light by cutting off the supply of the rectified power to two of the three LED arrays when it is determined that the voltage level of the rectified power decreases from 2 VF to 1 VF (i.e., 1 VF≤ the voltage level of the rectified power <2 VF).

Meanwhile, the driving controller 1040 according to this embodiment may be configured to control the first to third LED arrays 1010 to 1030 to be sequentially turned on/off according to the order in which the first to third LED arrays 1010 to 1030 are connected to one another. That is, the driving controller 1040 may be configured to control the first to third LED arrays 1010 to 1030 to be sequentially turned on from the first LED array 1010 toward third LED array 1030, and may be configured to control the first to third LED arrays 1010 to 1030 to be sequentially turned off from the third LED array 1030 toward the first LED array 1010. However, in such a control method, there is a problem in that the lifespan of the entire LED array is shortened as the first LED array 1010 most frequently emits light. Therefore, the driving controller 1040 according to this embodiment is preferably configured to control the first to third LED arrays to be sequentially turned off in the order in which the first to third LED arrays are sequentially turned on. That is, the driving controller 1040 according to this embodiment is preferably configured to extend the lifespan of the entire LED array by controlling the first to third LED arrays to be sequentially turned on in the order of the first LED array, the second LED array, and the third LED array, and then controlling the first to third LED arrays to be sequentially turned off in the order of the first LED array, the second LED array, and the third LED array.

Hereinafter, the specific configuration and function of the LED AC driver circuits according to exemplary embodiments of the present invention as described above will be described in detail with reference to FIGS. 11 and 12.

Figure 11:
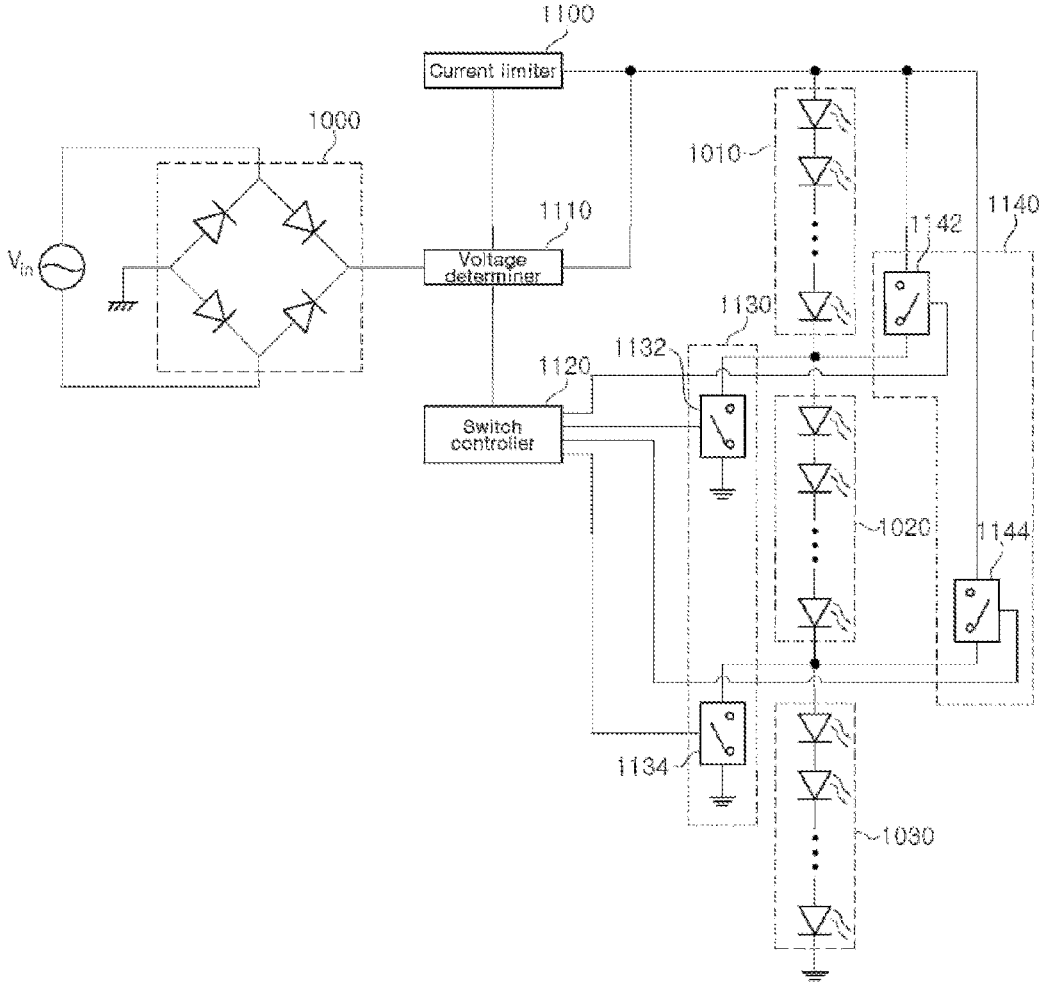
FIG. 11 is a circuit diagram of an LED AC driver circuit according to another embodiment of the present invention.

FIG. 11 is a circuit diagram of an LED AC driver circuit according to another embodiment of the present invention.

As shown in FIG. 11, the AC driver circuit according to this embodiment may include an AC power source Vin, a rectifier 1000, a plurality of LED arrays 1010, 1020 and 1030, an open switch 1130, a cutoff switch 1140, a switch controller 1120, a current limiter 1100 and a voltage determiner 1110. The open switch 1130, the cutoff switch 1140, the switch controller 1120, the current limiter 1100 and the voltage determiner 1110 constitute the driving controller 1040 shown in FIG. 6.

If AC power Vin is supplied to the driver circuit, the rectifier 1000 is configured to full-wave rectify the supplied AC power and output the rectified power.

The voltage determiner 1110 is connected to an output terminal of the rectifier 1000 so as to be configured to perform a function of receiving the rectified power which is output from the rectifier 1000, determining a voltage level of the rectified power which is input to the voltage determiner 1110, and outputting the determined voltage level to the switch controller 1120.

The current limiter 1100 is a component for driving the LED illuminating apparatus with a static current, and is configured to perform a function of maintaining the current flowing in LED arrays included in the LED AC driver circuit to have a predetermined value or to perform a function of constantly maintaining an input current and an output current. The static current control function employs a static current control technique previously known in the art, and therefore, its detailed description will be omitted.

Each of the plurality of LED arrays 1010, 1020 and 1030 includes a plurality of LEDs 24 connected to one another in series. The LED arrays 1010, 1020 and 1030 are sequentially connected to one another in series.

Meanwhile, as described above, it has been illustrated in the circuit diagram of FIG. 11 that the driver circuit includes three LED arrays, i.e., a first LED array 1010, a second LED array 1020 and a third LED array 1030. However, the driver circuit may include two or more LED arrays based on various embodiments of the present invention.

That is, the number of LED arrays according to this embodiment is at least two or more. When the number of LED arrays is n, m LED arrays may be turned on among n LED arrays. Here, m is a natural number ranging from 1 to n.

Accordingly, the number of open switches is n−1, the number of cutoff switches is n−1, and the first to (m+1)th LED arrays are turned on based on the turn-off state of an mth open switch. In the state in which the first to mth LED arrays are turned on among the n LED arrays, the first to lth LED arrays are turned off based on the turn-on state of an lth cutoff switch.

The open switch 1130 is a switch for turning on the LED arrays 1010, 1020 and 1030 connected in series to one another in the order in which they are connected. The open switch 1130 is configured to include a first open switch 1132 for controlling the turn-on/off of the first and second LED arrays 1010 and 1020, and a second open switch 1134 for controlling the turn-on/off of the second and third LED arrays 1020 and 1030.

To this end, the open switch 1130 is connected in series to the LED arrays 1010, 1020 and 1030 and the switch controller 1120. More specifically, the first open switch 1132 is connected in series to the first LED array 1010 and the switch controller 1120, so that the first and second LED arrays 1010 and 1020 are turned on as the first open switch 1132 is turned off and the second open switch 1134 is turned on, in the state in which the first open switch 1132 is turned on to turn on only the first LED array 1010.

Similarly, the second open switch 1134 is connected in series to the second LED array 1020 and the switch controller 1120. Accordingly, a current flows so that the first, second and third LED arrays 1010, 1020 and 1030 are turned on as the second open switch 1134 is turned off, in the state in which the first open switch 1132 is turned off and the second open switch 1134 is turned on to turn on only the first and second LED array 1010 and 1020.

The cutoff switch 1140 is a switch for turning off the LED arrays 1010, 1020 and 1030 connected in series to one another in the order in which they are turned on. The control switch 1140 is configured to include a first cutoff switch 1142 for turning off the first LED array 1010 in the state in which the whole LED arrays 1010, 1020 and 1030 are turned on, and a second cutoff switch 1144 for turning off the second LED array 1020 in the state in which the second and third LED arrays 1020 and 1030 are turned on.

To this end, the cutoff switch 1140 is connected in parallel to the LED arrays 1010, 1020 and 1030, and is connected in series to the switch controller 1120.

More specifically, the first cutoff switch 1142 is connected in parallel between a power input terminal and the first LED array 1010, and is connected in series to the switch controller 1120. Thus, the first LED array 1010 is turned off as the first cutoff switch 1142 is turned on, in the state in which the second LED array or more are turned on as well as the state in which the whole LED arrays 1010, 1020 and 1030 are turned on.

Similarly, the second cutoff switch 1144 is connected in parallel between the power input terminal and the second LED array 1020, and is connected in series to the switch controller 1120. Thus, the second LED array 1020 is turned off as the second cutoff switch 1144 is turned on, in the state in which the first cutoff switch 1142 is turned on to turn off only the first LED array 1010.

Since the switch controller 1120 is connected in series to the open and cutoff switches 1130 and 1140, the switch controller 1120 transfers an open/close command to the open switch 1130 and/or the cutoff switch 1140 so as to control the operation of each of the open and cutoff switches as the voltage level which is input from the voltage determiner 1110 increases or decreases.

An operating process of the LED AC driver circuit according to the present invention configured as described above will be described.

First, Table 1 is a table showing operations of the open and cutoff switches 1130 and 1140 based on the voltage level of the AC power Vin.

TABLE 1

| Vin | First Open S/W | Second Open S/W | First Cutoff S/W | Second Cutoff S/W |
|---|---|---|---|---|
| 0 ≤ Vin < 1VF | off | off | off | off |
| 1VF ≤ Vin < 2VF | on | off | off | off |
| 2VF ≤ Vin < 3VF | off | on | off | off |
| 3VF ≤ Vin | off | off | off | off |
| 2VF ≤ Vin < 3VF | off | off | on | off |
| 1VF ≤ Vin < 2VF | off | off | off | on |
| 0 ≤ Vin < 1VF | off | off | off | off |

First, if the AC power Vin is applied to the driver circuit, the AC power is full-wave rectified while passing through the rectifier 1000, and output as rectified power. Then, the rectified power output from the rectifier 1000 is transferred to the voltage determiner 1110.

The voltage determiner 1110 determines a voltage level of the rectified power applied from the rectifier 1000 and outputs the determined voltage level of the rectified power to the switch controller 1120. As shown in Table 1, when the voltage level of the rectified power increases to be equal to or greater than a forward voltage level (i.e., 1 VF) which can turn on one LED, the switch controller 1120 turns on the first open switch 1132. At this time, all the cutoff switches in the cutoff switch 1140 are in a turn-off state. Meanwhile, the voltage level input to the switch controller 1120 may be, in itself, the voltage value of the rectified power, or may be predetermined information corresponding to the voltage level of the rectified power. For convenience of illustration and understanding, the voltage level input to the switch controller 1120 will be described hereinafter based on predetermined information corresponding to each voltage level.

Thus, since the first open switch 1132 is turned on to form a current path from the first LED array 1010 via the first open switch 1132 to the ground connected to one end of the first open switch 1132, the rectified power is transferred to the first LED array 1010 so that the first LED array 1010 emits light.

If the voltage level of the rectified power increases to be equal to or greater than 2 VF in this state, the voltage determiner 1110 outputs the increased voltage level to the switch controller 1120, and the switch controller 1120 receiving the increased voltage level input from the voltage determiner 1110 turns off the first open switch 1132 and turns on the second open switch 1134.

Thus, since the first open switch 1132 is turned off and the second open switch 1134 is turned on to form a current path from the first LED array 1010 via the second LED array 1020 and the second open switch 1134 to the ground connected to one end of the second open switch 1134, the rectified power is transferred to the first and second LED arrays 1010 and 1020 so that the first and second LED arrays 1010 and 1020 emit light.

If the voltage level of the rectified power increases to be equal to or greater than 3 VF in this state, the voltage determiner 1110 outputs the increased voltage level to the switch controller 1120, and the switch controller 1120 receiving the increased voltage level input from the voltage determiner 1110 turns off both the first and second open switches 1132 and 1134.

Thus, since both the first and second open switches 1132 and 1134 are turned off to form a current path from the first LED array 1010 via the second LED array 1020 and the third LED array 1030 to the ground connected to one end of the third LED array 1030, the rectified power is transferred to the first to third LED arrays 1010 to 1030 so that all the first to third LED arrays 1010 to 1030 emit light.

If the voltage level of the rectified power decreases to be less than 3 VF in the state in which all the LED arrays 1010, 1020 and 1030 are turned on in the order in which they are connected as described above, the voltage determiner 1110 outputs the decreased voltage level to the switch controller 1120, and the switch controller 1120 receiving the decreased voltage level input from the voltage determiner 1110 turns on the first cutoff switch 1142 so that the first LED array 1010 that has been first turned on is turned off.

If the first cutoff switch 1142 is turned on in the state in which the first and second open switches 1132 and 1134 are turned off, the voltages at both ends of the first LED array 1010 are identical to each other, and therefore, the rectified power is not applied to the first LED array 1010. Thus, a current flows toward the second LED array 1020 and the third LED array 1030 via the first cutoff switch 1142 that is in a turn-on state. As a result, the first LED array 1010 is turned off.

If the voltage level of the rectified power decreases to be less than 2 VF in this state, the voltage determiner 1110 outputs the decreased voltage level to the switch controller 1120, and the switch controller 1120 receiving the decreased voltage level input from the voltage determiner 1110 turns on the second cutoff switch 1144 so that the second LED array 1020 is turned off.

Thus, in the state in which the first open switch 1132, the second open switch 1134 and the first cutoff switch 1142 are turned off and the second cutoff switch 1144 is turned on, a current does not pass through the first and second LED arrays 1010 and 1020 but flows toward the third LED array 1030 and the switch controller 1120 via the second cutoff switch 1144 that is in a turn-on state. As a result, the second LED array 1020 is also turned off.

If the voltage level of the rectified power decreases to be less than 1 VF in this state, the voltage determiner 1110 outputs the decreased voltage level to the switch controller 1120, and the switch controller 1120 receiving the decreased voltage level input from the voltage determiner 1110 turns off the first and second cutoff switches 1142 and 1144, thereby finishing a control process during one period of the rectified power.

The control process described above is a control process during one period of the rectified power, and is repeated at every period of the rectified power. Thus, as shown in Table 1, the first, second and third LED arrays 1010, 1020 and 1030 are sequentially turned on as the voltage level of the rectified power increases, while the first, second and third LED arrays 1010, 1020 and 1030 are sequentially turned off as the voltage level of the rectified power decreases.

Figure 12:
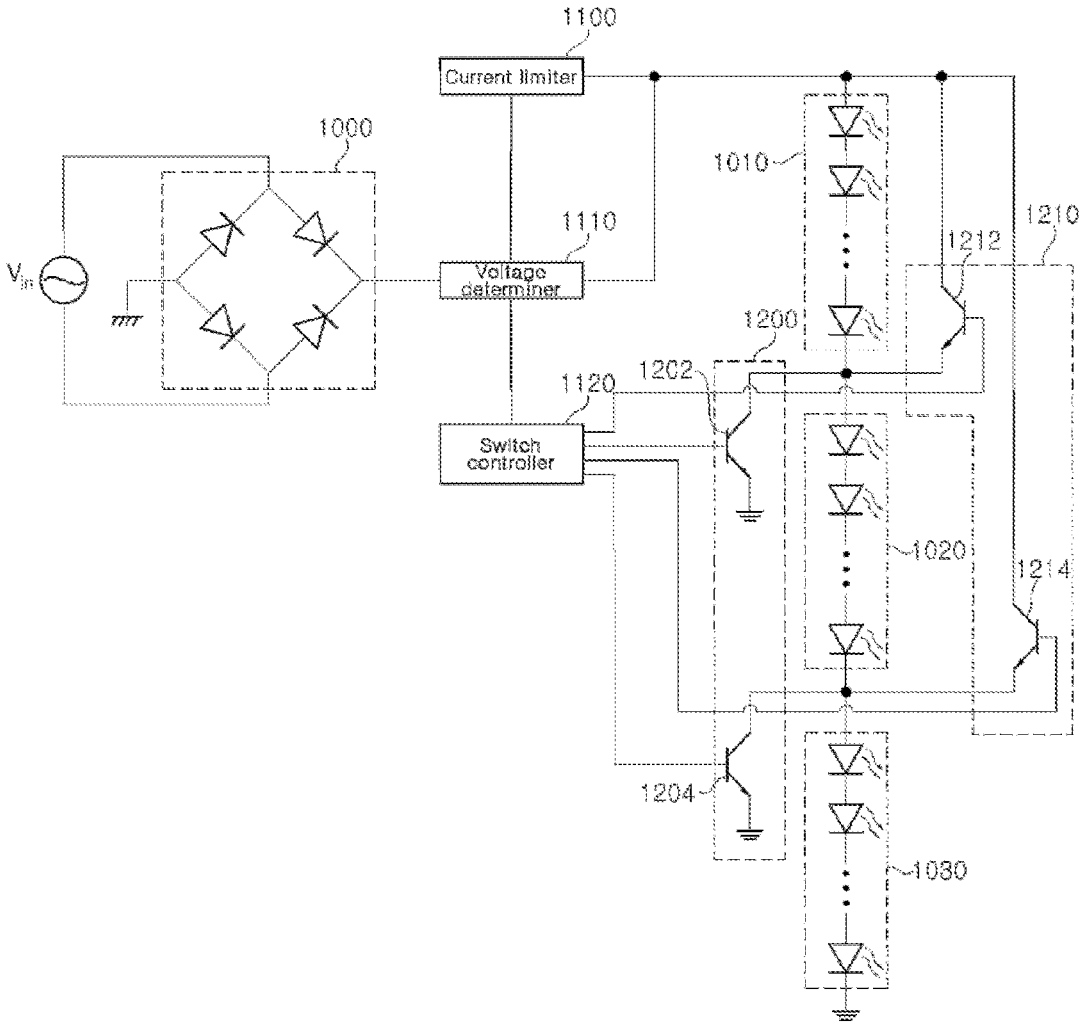
FIG. 12 is a circuit diagram of an LED AC driver circuit according to a further embodiment of the present invention.

FIG. 12 is a circuit diagram of an LED AC driver circuit according to a further embodiment of the present invention.

As shown in FIG. 12, the LED AC driver circuit according to this embodiment may include a rectifier 1000, a plurality of LED arrays 1010, 1020 and 1030, an open transistor 1200, a cutoff transistor 1210, a switch controller 1120, a current limiter 1100 and a voltage determiner 1110.

The embodiment shown in FIG. 12 differs from the embodiment described with reference to FIG. 11 only in that the open and cutoff switches 1130 and 1140 are implemented to be replaced with the open and cutoff transistors 1200 and 1210, respectively. Therefore, descriptions of overlapping contents will refer to the contents described with reference to FIG. 11, and overlapping descriptions will be omitted.

First, the open and cutoff switches 1130 and 1140 shown in FIG. 11 may be implemented using one switching device employed as occasion demands among various electronic switching elements (e.g., a transistor, a bipolar junction transistor (BJT), a field effect transistor (FET), and the like). A first open transistor 1202, a second open transistor 1204, a first cutoff transistor 1212 and a second cutoff transistor 1214 are shown in FIG. 12. Here, the first open transistor 1202, the second open transistor 1204, the first cutoff transistor 1212 and the second cutoff transistor 1214 implemented using NPN transistors replace the first open switch 1132, the second open switch 1134, the first cutoff switch 1142 and the second cutoff switch 1144, respectively.

A base terminal of each of the first open transistor 1202, the second open transistor 1204, the first cutoff transistor 1212 and the second cutoff transistor 1214 is connected to the switch controller 1120 so that each of the switches is turned on or turned off based on the control signal (control voltage) applied from the switch controller 1120. That is, if the switch controller 1120 applies a turn-on voltage to a base terminal of a specific switch, the corresponding switch may be turned on. If the switch controller 1120 does not apply the turn-on voltage to the base terminal of the specific switch, the corresponding switch may be turned off.

A collector terminal of the first open transistor 1202 is connected in series to the first LED array 1010, and an emitter terminal of the first open transistor 1202 is connected to the ground. Similarly, a collector terminal of the second open transistor 1204 is connected in series to the second LED array 1020, and an emitter terminal of the second open transistor 1204 is connected to the ground.

Further, a collector terminal of the first cutoff transistor 1212 is connected in parallel to the first LED array 1010, and an emitter terminal of the first cutoff transistor 1212 is connected in series to the collector terminal of the first open transistor 1202. Similarly, a collector terminal of the second cutoff transistor 1214 is connected in parallel between the power input terminal and the second LED array 1020, and an emitter terminal of the second cutoff transistor 1214 is connected in series to the collector terminal of the second open transistor 1204.

In this state, each of the transistors 1202, 1204, 1212 and 1214 is turned on and/or turned off under a control of the switch controller 1120 so as to control the light emission of each of the LED arrays based on the voltage level of the rectified power in the driver circuit.

Meanwhile, among the components shown in FIGS. 10 to 12, the rectifier 1000, the voltage determiner 1110, the switch controller 1120, the open switch 1130 (or 1200 of FIG. 12) and the cutoff switch 1140 (or 1210 of FIG. 12) may be configured with an integrated circuit (IC) so as to achieve a light and small LED illuminating apparatus.

Alternatively, although not shown in FIGS. 10 to 12, the LED illuminating apparatus according to this embodiment may further include a power factor compensation circuit for compensating for a power factor between the rectifier 1000 and the voltage determiner 1110. That is, an appropriate power factor compensation circuit may be selected from various power factor compensation circuits such as a valley-fill circuit, which are known in the art, as occasion demands. In this case, the power factor of the LED AC driver circuit according to the present invention can be improved, and the flicker phenomenon in the LED arrays can be reduced.

According to the embodiments, since the core structure necessary for covering components such as a wire and/or an SMPS is removed in the conventional LED illuminating apparatus, it is possible to decrease the weight of the LED illuminating apparatus according to the present invention. Further, since the number of components in the LED illuminating apparatus according to the present invention is decreased as compared with that of components in the conventional LED illuminating apparatus, the LED illuminating apparatus is economical, and can decrease its defective product ratio. Further, since components such as an SMPS is omitted, it is possible to improve the heat dissipation performance and a degree of freedom of design. Further, since the exposure area of the heat dissipation fins in the heat sink is increased, the heat dissipation performance can be more improved.

Although the present invention has been described above in connection with specific items, such as detailed elements, limited embodiments, and the drawings, they are provided to help the understanding of the present invention and the present invention is not limited to the above embodiments. Those skilled in the art can modify the present invention in various ways from the above description.

Accordingly, the scope of this document should not be limited to the above-described embodiments, but should be defined within the scope of the appended claims and equivalent thereof.

Further, it will be apparent to those skilled in the art, many modifications and applications are possible within the technical spirit and scope of the present invention, including that the illustrating apparatus according to the embodiments of the present invention may also be applied to factory or work lights, streetlights, scenery lighting lamps, or the like.

What is claimed is:

1. A light emitting diode (LED) illuminating apparatus, comprising:

a heat sink comprising a plurality of heat dissipation fins arranged on an external surface of the heat sink;

a light emitting module positioned on an upper portion of the heat sink;

a power connection portion positioned below a lower portion of the heat sink;

a translucent cover mounted to cover an upper portion of the light emitting module; and a wire electrically connecting the power connection portion and the light emitting module, the wire extending through a wiring path formed in one of the heat dissipation fins, wherein the light emitting module emits light by directly receiving AC power (Vin) supplied through the wire accommodated in the wiring path, wherein the wiring path has a hollow formed to be connected from a top end of the heat dissipation fin to a bottom end thereof.

2. The LED illuminating apparatus according to claim 1, wherein the light emitting module comprises:

a circuit board which has an electric wire for receiving AC power supplied through the electric wire; and an AC LED emitting light by receiving the AC power supplied through the electric wire.

3. The LED illuminating apparatus according to claim 2, wherein the AC LED comprises:

a first LED array having a plurality of LEDs connected in series to one another; and a second LED array having a plurality of LEDs connected in series to one another, and connected in reverse parallel to the first LED array having a different polarity therefrom.

4. The LED illuminating apparatus according to claim 2, wherein the AC LED comprises:

a first LED array having a plurality of LEDs connected to form a bridge circuit, and outputting a rectified power by receiving the AC power; and a second LED array having a plurality of LEDs connected in series to one another, and emitting light by receiving the rectified power applied from the first LED array.

5. The LED illuminating apparatus according to claim 2, wherein the AC LED comprises:

first to nth LED arrays (n is an even number greater than 2), each LED array comprising a plurality of LEDs connected in series; and bridge portions connecting the first to nth LED arrays to one another, wherein output terminals of two bridge portions are connected to each of input terminals of second to (n−1)th LED arrays disposed between the first LED array and the nth LED array, an input terminal of a first bridge portion of the two bridge portions is connected to an output terminal of the preceding LED array, and an input terminal of a second bridge portion of the two bridge portions is connected to an output terminal of the following LED array, and an input terminal of the first LED array is connected to an output terminal of the second LED array, and an input terminal of the nth LED array is connected to an output terminal of the (n−1)th LED array.

6. The LED illuminating apparatus according to claim 5, wherein the first to nth LED arrays are arrayed in parallel with one another, and input and output terminals of the first to nth LED arrays are positioned to be alternately changed from each other.

7. The LED illuminating apparatus according to claim 5, wherein each of the bridge portions comprises at least one LED.

8. The LED illuminating apparatus according to claim 2, wherein the AC LED comprises:

first to nth LED arrays (n is an even number greater than 2), each LED array comprising a plurality of LEDs connected in series; and bridge portions connecting the first to nth LED arrays to one another, wherein input terminals of two bridge portions are connected to each of output terminals of second to (n−1)th LED arrays disposed between the first LED array and the nth LED array, an output terminal of a first bridge portion of the two bridge portions is connected to an input terminal of the preceding LED array, and an output terminal of a second bridge portion of the two bridge portions is connected to an input terminal of the following LED array, and an output terminal of the first LED array is connected to an input terminal of the second LED array, and an output terminal of the nth LED array is connected to an input terminal of the (n−1)th LED array.

9. The LED illuminating apparatus according to claim 8, wherein the first to nth LED arrays are arrayed in parallel with one another, and input and output terminals of the first to nth LED arrays are positioned to be alternately changed from each other.

10. The LED illuminating apparatus according to claim 8, wherein each of the bridge portions comprises at least one LED.

11. The LED illuminating apparatus according to claim 2, wherein the AC LED comprises a plurality of AC LED packages connected in series to one another, wherein each of the LED packages comprises:

a first light emitting cell array having a plurality of light emitting cells connected in series to one another; and a second light emitting cell array having a plurality of light emitting cells connected in series to one another, and connected in reverse parallel to the first LED array having a different polarity therefrom.

12. The LED illuminating apparatus according to claim 1, wherein the light emitting module comprises:

a circuit board receiving AC power supplied through the wire;

a rectifier rectifying the AC power and outputting the rectified power;

a driving controller, connected to an output terminal of the rectifier, determining a voltage level of the rectified power input to the rectifier and controlling an operation of the AC LED based on the determined voltage level; and an LED array emitting light by receiving the rectified power output from the rectifier under a control of the driving controller.

13. The LED illuminating apparatus according to claim 12, wherein the LED array comprises first to nth LED arrays (n is a positive integer of 2 or more) each having a plurality of LEDs connected in series to one another, wherein the driving controller controls the first to nth LED arrays to be sequentially turned on or turned off based on the determined voltage level.

14. The LED illuminating apparatus according to claim 13, wherein the driving controller controls the first to nth LED arrays to be turned off in the order in which the first to nth LED arrays are turned on.

15. The LED illuminating apparatus according to claim 14, wherein the driving controller comprises:

a voltage determiner determining a voltage level of the rectified power applied from the rectifier, and outputting the determined voltage level to a switch controller;

an open switch connected in series to each of the first to nth LED arrays so that the first to nth LED arrays are turned on in the order in which the first to nth LED arrays are connected, based on the increase in the voltage level of the rectified power;

a cutoff switch connected in parallel to each of the first to nth LED arrays so that the first to nth LED arrays are turned off in the order in which the first to nth LED arrays are turned on, based on the decrease in the voltage level of the rectified power; and the switch controller connected to each of the (n−1) open switches, the (n−1) cutoff switches and the voltage determiner so as to control opening/closing operations of the switches based on the increase/decrease in the voltage level input from the voltage determiner.

16. The LED illuminating apparatus according to claim 15, wherein the open switch comprises (n−1) open switches respectively connected in series from the first LED array to the (n−1)th LED array, wherein in the state in which a first open switch is turned on through the supply of voltage so as to turn on the first LED array, the first open switch to an mth open switch (m is a positive integer ranging from 2 to (n−1)) are sequentially turned off under a control command of the switch controller according to the increase in the voltage level, and the first LED array to an nth LED array are turned on as the second open switch to an mth open switch are sequentially turned on.

17. The LED illuminating apparatus according to claim 16, wherein the cutoff switch comprises (n−1) cutoff switches respectively connected in parallel between a power input terminal and the LED arrays from the first LED array to the (n−1)th LED array, wherein an Ith LED array is turned off as a first cutoff switch to an Ith cutoff switch (I is a positive integer ranging from 2 to (n−1)) are sequentially turned on under a control command of the switch controller according to the decrease in the voltage level, in the state in which the first LED array to the Ith LED array are turned on.

18. The LED illuminating apparatus according to claim 15, wherein the open and cutoff switches are configured as transistors, and the switch controller is connected to a base of the transistor so that the transistor is turned on or turned off by a control voltage supplied from the switch controller.

19. The LED illuminating apparatus according to claim 1, wherein an empty space is formed inside inner corners of the heat dissipation fins.

20. The LED illuminating apparatus according to claim 2, wherein the heat sink has a heat dissipation plate integrally connected to an upper portion of the heat dissipation fins, and the circuit board is mounted on the heat dissipation plate.

21. The LED illuminating apparatus according to claim 20, wherein a wiring hole is formed through the heat dissipation plate, and the wiring hole is positioned at one side of a slot concavely formed from a top of the heat dissipation plate.

22. The LED illuminating apparatus according to claim 20, wherein the heat dissipation plate has a concave portion in which the circuit board is accommodated, a ring-shape frame portion is formed along a top edge of the concave portion, and a plurality of heat dissipation holes are formed in the ring-shaped frame portion.

23. The LED illuminating apparatus according to claim 22, wherein the translucent cover is coupled to an upper portion of the heat sink, and the heat dissipation holes are exposed to the outside of the translucent cover.

24. The LED illuminating apparatus according to claim 1, wherein the power connection portion has a socket base, and an insulator is mounted between the socket base and the heat sink.

* * * * *